United States Patent [19]

Goto et al.

[11] Patent Number: 4,517,032

[45] Date of Patent: May 14, 1985

[54] METHOD OF PRODUCING GRAIN-ORIENTED SILICON STEEL SHEETS HAVING EXCELLENT MAGNETIC PROPERTIES

[75] Inventors: Tomomichi Goto, Kobe; Katsuo Iwamoto, Kakogawa; Yoshinori Kobayashi, Takarazuka; Isao Matoba, Kobe, all of Japan

[73] Assignee: Kawasaki Steel Corporation, Kobe, Japan

[21] Appl. No.: 474,556

[22] Filed: Mar. 11, 1983

[30] Foreign Application Priority Data

Mar. 15, 1982 [JP] Japan ..... 57-39557

[51] Int. Cl.[3] ..... H01F 1/04

[52] U.S. Cl. ..... 148/111; 148/112

[58] Field of Search ..... 148/110, 111, 112, 113

[56] References Cited

U.S. PATENT DOCUMENTS

| | | | |
|---|---|---|---|
| 2,378,321 | 6/1945 | Pakkala | 148/112 |
| 3,636,579 | 1/1972 | Sakakura et al. | 148/111 |
| 3,855,021 | 12/1974 | Salsgiver et al. | 148/111 |
| 3,959,033 | 5/1976 | Barisoni et al. | 148/111 |

*Primary Examiner*—John P. Sheehan

*Attorney, Agent, or Firm*—Balogh, Osann, Kramer, Dvorak, Genova & Traub

[57] ABSTRACT

A grain-oriented silicon steel sheet having high magnetic induction and low iron loss can be produced by controlling properly the particle size of carbide precipitated in the crystal grains of the steel sheet before final cold rolling. Further, the magnetic properties can be more improved by adjusting the C content in a starting silicon steel depending upon the Si content in the steel and removing a proper amount of C from the steel during the course after completion of hot rolling and before final cold rolling, in addition to the proper control of the particle size of carbide precipitated in the crystal grains of the steel sheet before final cold rolling.

4 Claims, 14 Drawing Figures

FIG. 2(A-1)
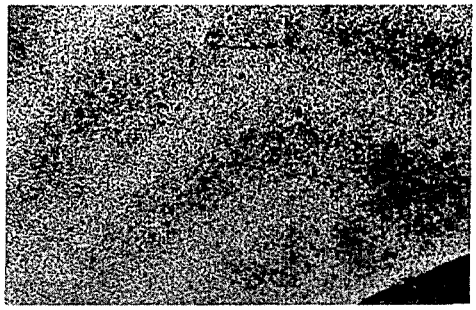
(x 10000)
FIG. 2(B-1)
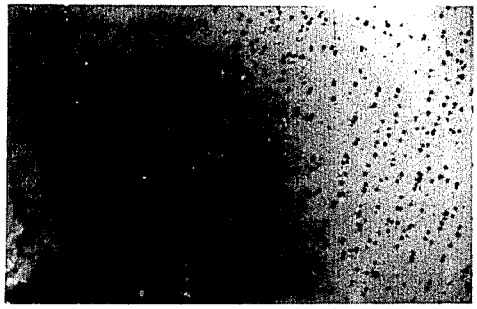
(x 10000)

FIG. 2(A-2)
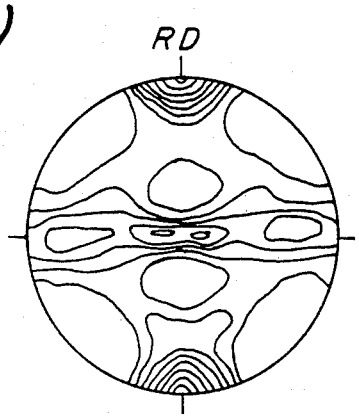
FIG. 2(B-2)
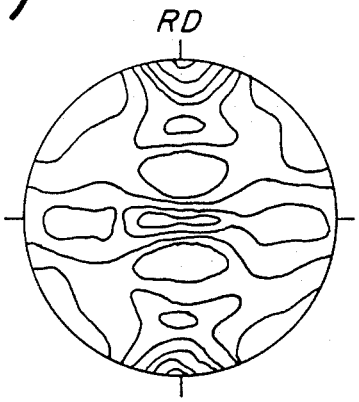

| | Mark | Range of [Si %] | | |
|---|---|---|---|---|
| | | 2.8~3.1% | 3.3~3.5% | 3.6~3.8% |
| $W_{17/50}$ (w/kg) | ◎ | ≦1.05 | ≦1.00 | ≦0.95 |
| | ○ | ≦1.10 | ≦1.05 | ≦1.00 |
| | ● | ≦1.15 | ≦1.10 | ≦1.05 |
| | × | >1.15 | >1.10 | >1.05 |

METHOD OF PRODUCING GRAIN-ORIENTED SILICON STEEL SHEETS HAVING EXCELLENT MAGNETIC PROPERTIES

BACKGROUND OF THE INVENTION (1) Field of the Invention

The present invention relates to a method of producing grain-oriented silicon steel sheets having an easy magnetization axis <001> in the rolling direction.

(2) Description of the Prior Art

Grain-oriented silicon steel sheets are mainly used in iron cores of a transformer and other electric instruments. Recently, it has become an important problem to decrease the electric power loss and to use efficiently the electric power of a transformer and other electric instruments in view of energy saving and resource saving, and grain-oriented silicon steel sheets having more improved magnetic properties have been demanded. As the magnetic properties of grain-oriented silicon steel sheet, which can satisfy the above described demands, there have been required an excitation property of a magnetic induction of $B_{10}$ value of at least 1.85 Tesla in the rolling direction under a magnetic field intensity of 1,000 A/m, and a low iron loss of not more than 1.20 W/kg of $W_{17/50}$ (iron loss under a magnetic induction of 1.7 Tesla and at an alternate current of 50 Hz). Recently, an excellent grain-oriented silicon steel sheet having a low iron loss of $W_{17/50}$ of not more than 1.10 W/kg has been obtained.

In the production of grain-oriented silicon steel sheets having such excellent magnetic properties, it is necessary to develop completely secondary recrystallized grains during the final annealing in the production process of the sheets, and to produce the product steel sheet formed of secondary recrystallized grains having a strong (110)[001] orientation.

In order to develop completely secondary recrystallized grains, it is commonly known that it is indispensable to use an inhibitor which suppresses strongly the normal grain growth of primary recrystallized grains having an undesirable orientation other than the (001)[001] orientation during the secondary recrystallization stage. As the inhibitors, there are generally used fine precipitates of MnS, MnSe, AlN and the like, and the precipitated state of these fine precipitates is controlled mainly in the hot rolling step to develop strongly the inhibiting effect. Recently, the above described fine precipitates are used together with grain boundary segregation elements, such as Sb, Bi, Sn, Pb, Te and the like, to supplement the effect for suppressing the growth of primary recrystallized grains having undesirable orientation and to develop fully the action as an inhibitor.

Further, in order to develop completely secondary recrystallized grains, it is very important not only to use the above described inhibitor, but also to form primary recrystallization texture which can develop predominantly secondary recrystallized grains having (110)[001] orientation in a steel sheet before the final annealing. Such primary recrystallization texture can be obtained only when treating conditions in all process from the hot rolling process to the cold rolling process in the production of grain-oriented silicon steel sheet are properly combined. Particularly, it is important to select properly the final cold rolling reduction rate depending upon the strength of the suppression effect of inhibitor. For example, it is known that, when MnS or MnSe is used as an inhibitor, a proper final cold rolling reduction rate is within the range of 40–80%, and in this case an optimum primary recrystallization texture is formed of strong (110)[001] orientation as a main component and weak $\{111\}<11\bar{2}>$ orientation as a subcomponent.

Recently, there has been developed a method for improving the primary recrystallization texture by utilizing effectively carbon or carbide contained in steel. For example, Japanese Patent Application Publication No. 14,009/63 proposes a method, wherein a hot rolled sheet is very rapidly cooled before the first cold rolling from a temperature of not lower than 790° C. to a temperature of not higher than 540° C., and then kept to a temperature of 310°–480° C. to precipitate lens-shaped carbides having an optical-microscopically visual size (several μm ) in the crystal grains. The resulting relatively large size carbide particles act effectively in order that elongated coarse grains formed during the hot rolling step are divided into small size. That is, the large size carbides have probably an action for reducing coarse grains having (100)[011]–(110)[011] orientations, which are harmful for the development of secondary recrystallized grains, in the initial stage of cold rolling.

Further, there has been recently developed a method, wherein solute C or finely dispersed carbide in crystal grains is utilized during the cold rolling. Japanese Patent Application Publication Nos. 13,846/79 and 29,182/79 disclose a method, wherein a hot rolled sheet containing AlN as an inhibitor is heated to a high temperature and then rapidly cooled, and the annealed steel sheet is subjected to one time of cold rolling at a high cold rolling reduction rate of at least 80%, and further to at least one time of ageing treatment between the cold rolling passes. The above described Japanese patent application publications describe that, in this ageing treatment, it is necessary to keep the steel sheet to a temperature within the range of 50°–350° C. for at least one minute or to a temperature within the range of 300°–600° C. for 1–30 seconds, and further a large number of repeating ageing treatments are effective. However, according to such method, the cold rolling efficiency is very poor, and a high cost is required in the ageing treatment of steel sheet, and therefore the method is not economical. The inventors have disclosed in Japanese Patent Application Publication No. 19,377/81 a method, wherein a combination system of AlN and Sb is used as an inhibitor, and a cooling in an intermediate annealing is carried out such that a steel sheet heated in the intermediate annealing is gradually cooled within the temperature range of 900°–700° C. in 200–2,000 seconds, and then immediately rapidly cooled from 700° C. to a temperature of not higher than 200° C. in 4 minutes, preferably at a very high cooling rate similar to water quenching, in order to exhibit the effect of the combination use of AlN and Sb. However, when it is intended to cool gradually a steel sheet from 900° to 700° C. in 200–2,000 seconds, it is necessary that the cooling zone of a continuous annealing furnace is greatly remodeled to arrange a very long gradual cooling zone, within which the steel sheet is substantially heated and thermally insulated, and further the continuous annealing furnace is operated at a low speed. Therefore, this method is not an economical method due to the low production efficiency of the product steel sheet and the high production cost thereof, and cannot be practically carried out. Moreover, all the above described three methods can develop their effect only when the use of a specifically limited inhibitor of AlN or Aln—Sb is combined with the high final cold rolling reduction rate of at least 80%. The primary recrystallization texture obtained by these methods is formed of very strong $\{111\}<11\bar{2}>$ orientation as a main component and weak (110)[001] orientation as a sub-component. Therefore, the above described three methods are fundamentally different from a method for developing primary recrystallization texture having strong (110)[001] orientation, and moreover the methods have not been able to be applied to the production of grain-oriented silicon steel sheet by the use of a commonly used inhibitor of MnS or MnSe.

According to Japanese Patent Application Publication No. 3,892/81, which is one of commonly known methods, wherein at least one of MnS and MnSe is used as an inhibitor and carbon contained in a steel is effectively utilized in order to improve the recrystallization texture by carrying out a final cold rolling at a reduction rate suitable for the inhibitor, a steel sheet heated in the intermediate annealing is cooled at a rate of at least 150° C./min within the temperature of 600°–300° C., and the intermediately annealed steel sheet is subjected to an ageing treatment during the final cold rolling. In this method also, it is necessary that the ageing treatment is carried out at a temperature of 100°–400° C. for from 5 seconds to 30 minutes and at least one time of the above described ageing treatment is carried out between cold rolling passes. Therefore, this method is not economic due to the low cold rolling efficiency and the high ageing treatment cost as described above, and a more effective method has hitherto been demanded.

Recently, a continuous casting method is used in place of a conventional ingot making-slabbing method in the production of a slab to be used as a starting material for the production of grain-oriented silicon steel sheets. However, the use of a continuously cast slab increases troubles, which are few cases in the conventional ingot making-slabbing method, in the grain-oriented silicon steel sheet product. That is, when it is intended to obtain fine precipitates of MnS, MnSe, AlN and the like, which are effective as an inhibitor, it is necessary that a slab is heated at a high temperature of not lower than 1,250° C. for a long period of time before the hot rolling to dissociate and to solid solve fully the inhibitor element into the steel, and the cooling step at the hot rolling is controlled to precipitate the inhibitor element having a proper fine size. However, in the continuously cast slab, extraordinarily coarse crystal grains are apt to develop during the high temperature slab heating as described above, and incompletely developed secondary recrystallized texture called as poorly oriented fine grain streaks is formed in the resulting silicon steel sheet due to the extraordinarily coarse slab grains, and the silicon steel sheet is often poor in the magnetic properties.

There have hitherto been proposed several methods in order to prevent the formation of the above-described fine grain streaks and to improve the magnetic properties. For example, Japanese Patent Laid-Open Application No. 119,126/80 discloses a method, wherein a slab is subjected to a recrystallization rolling at a high reduction rate when the slab is hot rolled into a given thickness, that is, the texture of the slab just before the recrystallization rolling is controlled such that $\alpha$-phase matrix contains at least 3% of precipitated $\gamma$-phase iron, and the slab is subjected to a recrystallization rolling at a high reduction rate of not less than 30% per one pass within the temperature range of 1,230°–960° C. The inventors have proposed in Japanese Patent Application No. 31,510/81 a method, wherein a slab is mixed with a necessary amount of C depending upon the Si content, and not less than a given amount of $\gamma$-phase iron is formed within a specifically limited temperature range during the hot rolling, whereby coarse slab grains developed during the high temperature heating are broken to prevent effectively the formation of fine grain streaks in the product.

However, according to the above described method of forming not less than a given amount of $\gamma$-phase iron in a slab during its hot rolling, although formation of the fine grain streaks in the product can be prevented, the aimed magnetic properties can be not always obtained, and moreover the prevention of the formation of the fine grain streaks is very unstable, and poorly oriented fine grain texture may be formed all over the product to deteriorate noticeably its magnetic properties. Therefore, this method is still insufficient in the stability of the effect, which is a most important factor in the commercial production of grain-oriented silicon steel sheets.

SUMMARY OF THE INVENTION

The object of the present invention is to provide a method of producing grain-oriented silicon steel sheets inexpensively and efficiently in a commercial scale, which has not the above described various drawbacks of the above described conventional methods, directing to use effectively carbon contained in steel.

The inventors have variously investigated in order to attain the above described object, and found out a method of producing efficiently and inexpensively grain-oriented silicon steel sheets having excellent magnetic properties by a method, wherein the state of carbide particles contained in the crystal grains of a steel sheet is controlled, after the steel sheet is heated in the intermediate annealing carried out before the final cold rolling, to such a precipitated state that the carbide particles have a specifically limited very fine size and are fully dispersed in the crystal grains of the steel sheet, and accomplished the present invention. This is the first aspect of the present invention.

The inventors have further investigated, and found out that, when the following three requirements are combined, grain-oriented silicon steel sheets having more improved magnetic properties can be obtained. This is the second aspect of the present invention. First, the state of carbide particles contained in the crystal grains of a steel sheet is controlled, after the steel sheet is heated in the intermediate annealing carried out before the final cold rolling, to such a precipitated state that the carbide particles have a specifically limited very fine size and are fully dispersed in the crystal grains of the steel sheet. Secondly, the C content in a silicon steel to be used as a starting material is adjusted to a proper amount depending upon the Si content in the steel in order to control the amount of $\gamma$-phase iron to be formed during the hot rolling to a proper range. Thirdly, a given amount of C is removed from the steel sheet during the course after completion of the hot rolling and before the final cold rolling.

The first aspect of the present invention lies in a method of producing grain-oriented silicon steel sheets having excellent magnetic properties, wherein a silicon steel having a composition containing, in % by weight, 0.02–0.10% of C, 2.5–4.0% of Si, 0.02–0.15% of Mn and 0.008–0.080% in a total amount of at least one of S and Se is hot rolled into a hot rolled sheet, the hot rolled sheet is subjected to two cold rollings with an intermediate annealing at a temperature of 770°–1,100° C. between them, wherein the final cold rolling is carried out at a reduction rate of 40–80%, to produce a finally cold rolled sheet having a final gauge, and the finally cold rolled sheet is subjected to a decarburization annealing and then to a final annealing, an improvement comprising controlling the state of carbide particles contained in the crystal grains of the steel sheet, after the steel sheet is heated in the intermediate annealing, to such a precipitated state that the carbide particles have a very fine size of substantially 100–500 Å and are fully dispersed in the crystal grains of the steel sheet, and then subjecting the steel sheet to the final cold rolling.

The second aspect of the present invention lies in a method of producing grain-oriented silicon steel sheets having excellent magnetic properties, wherein the C content in the starting silicon steel is limited, depending upon the Si content, within the range defined by the following formula $$0.37[Si\%]+0.27 \leqq \log([C\%]\times 10^3) \leqq 0.37[Si\%]+0.57$$

wherein [Si%] and [C%] represent contents (% by weight) of Si and C in the steel respectively, and 0.006–0.020% by weight of C is removed from the steel during the course after the completion of the above described hot rolling and just before the beginning of the above described final cold rolling, in the above described method of the first aspect of the present invention.

In the above described first and second aspects of the present invention, the control of carbide particles to a very fine size of substantially 100–500 Å dispersed in the crystal grains of the steel sheet is carried out according to the following two methods.

In one of the methods, the steel sheet heated in the intermediate annealing is rapidly cooled within the temperature range of 770°–100° C. within 30 seconds, the rapidly cooled sheet is immediately subjected to an ageing treatment at a temperature of 150°–250° C. for 2–60 seconds to precipitate carbide particles having a very fine size of substantially 100–500 Å in a fully dispersed state in the crystal grains of the steel sheet.

In another method, the steel sheet heated in the intermediate annealing is rapidly cooled within the temperature range of 770°–300° C. within 20 seconds, the rapidly cooled sheet is successively cooled within the temperature range of 300°–150° C. in 8–30 seconds to precipitate carbide particles having a very fine size of substantially 100–500 Å in a fully dispersed state in the crystal grains of the steel sheet.

BRIEF DESCRIPTION OF THE DRAWINGS

FIG. 2(A-1) is an electron microphotograph (10,000 magnifications) illustrating a precipitated state of carbide in crystal grains in a sample steel sheet in the case where the sample steel sheet heated in an intermediate annealing is rapidly cooled and then subjected to an ageing treatment at 200° C. for 10 seconds according to the method of the present invention;

FIG. 2(A-2) is a pole figure {200} illustrating the primary recrystallization texture of the sample steel sheet shown in FIG. 2(A-1) after decarburization annealing and before final annealing;

FIG. 2(B-1) is an electron microphotograph (10,000 magnifications) illustrating the precipitated state of carbide in crystal grains in a sample steel sheet in the case where the sample steel sheet heated an intermediate annealing is cooled according to a conventional standard cooling method;

FIG. 2(B-2) is a pole figure {200} illustrating the primary recrystallization texture of the sample steel sheet shown in FIG. 2(B-1) after decarburization annealing and before final annealing;

DESCRIPTION OF THE PREFERRED EMBODIMENT

Figure 1:
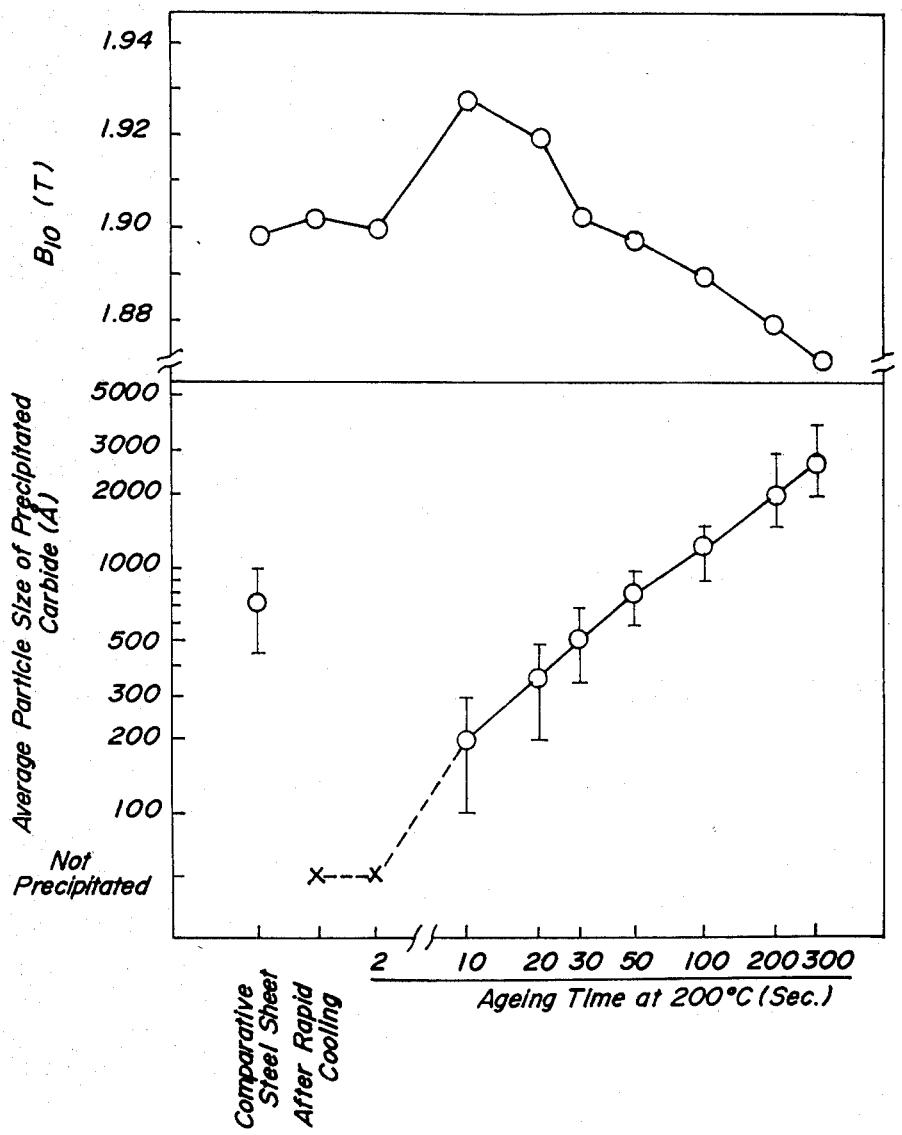
FIG. 1 is a graph illustrating a relation between the ageing time and the $B_{10}$ value or the particle size of precipitated carbide in the case where a steel sheet heated in an intermediate annealing is rapidly cooled and then subjected to an ageing treatment.

The first aspect of the present invention will be explained in more detail.

The inventors have diligently studied in order to attain the above described object, and have found out that, when carbide contained in the crystal grains of an intermediately annealed steel sheet before the final cold rolling is controlled to such an ultra-fine particle size which cannot be observed by an optical microscope and has not hitherto been taken into consideration, and further a sufficiently large amount of the carbide particles are precipitated and dispersed in the crystal grains, the recrystallization texture of the finally cold rolled and decarburized steel sheet before the final annealing can be improved to a texture having strong (110)[001] orientation, and hence secondary recrystallized grains aligned closely to (110)[001] orientation can be fully developed during the secondary recrystallization stage in the final annealing, and excellent magnetic properties can be obtained. That is, the inventors have found out that, when the cooling condition within the temperature range of not higher than 300° C. of a steel sheet heated in the intermediate annealing, which cooling condition has not higherto been taken into consideration, is strictly controlled in order to precipitate the above described ultra-fine carbide particles in the crystal grains of the steel sheet, the recrystallization texture of the steel sheet before the final annealing can be made into a recrystallization texture having strong (110)[001] orientation, and accomplished the first aspect of the present invention.

According to the present invention, as a starting material, use may be made of a slab having a composition containing 0.02–0.10% (in the specification, "%" relating to the amount of composition of steel means "% by weight") of C, 2.5–4.0% of Si, 0.02–0.15% of Mn, 0.008–0.080% in a total amount of at least one of S and Se. The slab can be produced by an ingot making-slabbing method or by a continuous casting method.

An explanation will be made with respect to the reason for limiting the composition of the slab to be used as a starting material in the present invention.

C is an essential component for developing the effect for improving the recrystallization texture by utilizing ultra-fine carbide in the present invention. When the content of C is less than 0.02%, a sufficiently large amount of ultra-fine carbide cannot be precipitated, while when the content exceeds 0.10%, decarburization before final annealing is very difficult, and a long period of time of decarburization annealing is required, and the operation is expensive. Accordingly, the content of C must be within the range of 0.02–0.10%.

Si is a necessary element for improving the specific resistance and for lowering the iron loss of steel. When the Si content is lower than 2.5%, a sufficiently low iron loss cannot be obtained, and a part of the steel sheet is transformed from $\alpha$-phase into $\gamma$-phase during high temperature final annealing to deteriorate the secondary recrystallization orientation. While, when the Si content exceeds 4.0%, the steel is very brittle, is poor in the cold rollability, and is difficult to be cold rolled by an ordinary commercial rolling operation. Therefore, the Si content must be within the range of 2.5–4.0%.

Mn, S and Se act as an inhibitor and are necessary elements for suppressing the development of primary recrystallized grains having an undesirable orientation other than the (110) [001] orientation and to develop fully secondary recrystallized grains having (110)[001] orientation during the secondary recrystallization. When the Mn, S and Se contents are outside the range defined in the present invention, a sufficiently high effect as an inhibitor cannot be attained. Therefore, the Mn content must be within the range of 0.02–0.15%, and the content in total of at least one of S and Se must be within the range of 0.008–0.080%.

The silicon steel to be used in the present invention, in addition to the above described indispensable elements, may contain occasionally grain boundary segregation type elements, such as Sb, As, Bi, Pb, Sn, Te, Mo, W and the like, alone or in admixture, to promote the effect of the inhibitor by necessity, especially in the case of high final cold rolling reduction rate. However, when a final cold rolling reduction rate higher than 80% is required, the effect for improving the recrystallization texture aimed in the present invention cannot be attained even in the presence of the grain boundary segregation type elements. Therefore, the grain boundary segregation type elements may not be recommendable to use without necessity.

Then, an explanation will be made with respect to the rolling condition and heat treatment condition of the above described slab.

A slab having the above described composition is heated to a high temperature of not lower than 1,250° C., hot rolled by a commonly known method to produce a hot rolled sheet having a thickness of 1.5–5.0 mm. In this hot rolling step, the high temperature for heating the slab must be properly set depending upon the content of Mn, S and Se in order that these elements can be fully dissociated and solid solved so as to obtain fine precipitates of inhibitors of MnS and MnSe in a subsequent hot rolling step; and further it is important to select properly the hot rolling method in order to promote the precipitation of very fine particles of the inhibitors.

The hot rolled sheet is occasionally subjected to a normalizing annealing. The hot rolled sheet, with or without the normalizing annealing, is pickled and then subjected to two cold rollings with an intermediate annealing between them to produce a finally cold rolled sheet having a final gauge. The intermediate annealing is carried out in order to recrystallize the cold rolled grains in the first cold rolled steel sheet, to promote the formation of uniform crystal structure, and to solid solve fully C in the steel. Accordingly, the intermediate annealing temperature must be not lower than 770° C. However, when the intermediate annealing temperature exceeds 1,100° C., fine precipitate of an inhibitor of MnS or MnSe is formed into a coarse particle, resulting in a deterioration of the inhibiting effect. Therefore, the intermediate annealing temperature must be within the range of 770°–1,100° C.

One of the indispensable requirements of the first aspect of the present invention is to precipitate fully ultra-fine carbide particles having a size of substantially 100–500 Å in the crystal grains of a steel sheet before the final cold rolling. This fact will be explained in detail referring to experimental data.

In the experiment, there was used a hot rolled steel sheet having a thickness of 3.0 mm, which had been produced from a slab containing 0.045% of C, 3.20% of Si, 0.06% of Mn and 0.025% of Se through conventional steel making, continuous casting and hot rolling steps. The hot rolled sheet was annealed at 950° C. for 2 minutes, pickled and then subjected to a first cold rolling to produce a sheet having an intermediate thickness of 0.75 mm. The first cold rolled sheet was subjected to an intermediate annealing at 900° C. for 3 minutes, and then to a final cold rolling at a reduction rate of 60% to produce a cold rolled sheet having a final gauge of 0.30 mm. Then, the finally cold rolled sheet was subjected to a decarburization annealing under a wet hydrogen atmosphere kept at 800° C., applied with MgO, and subjected to a final annealing of a combination of a secondary recrystallization annealing, wherein the steel sheet was kept at 860° C. for 30 hours during the temperature-raising step to develop fully secondary recrystallized grains, and a purification annealing, wherein the steel sheet was further heated and kept at 1,200° C. for 10 hours to remove impurities contained in the steel sheet, to produce a grain-oriented silicon steel sheet product. During the above described treating steps, the cooling rate within the temperature range of not higher than 770° C. of the steel sheet heated up to 900° C. in the intermediate annealing was variously changed by water quenching, oil quenching, mist jet cooling, forced air-cooling with a variant air flow rate, and natural cooling. Following to the cooling, a part of the cooled steel sheets were immediately subjected to an ageing treatment within the temperature range of 150°–300° C. in an oil tank kept to a constant temperature. The above treated steel sheets before the final cold rolling were examined with respect to the precipitated state of carbide particles in the crystal grains by means of an electron microscope having a high magnification (10,000 magnifications). The reason why the temperature, at which the change of the cooling rate of the steel sheet heated in the intermediate annealing is started, is set to 770° C. is that the precipitation of carbide particles in the grain boundary occurs at about 770° C., and that the rapid cooling of the steel sheet from a temperature higher than 770° C. deforms the shape of the steel sheet and causes troubles in the following treating steps.

FIG. 1 illustrates relations between the ageing time and the particle size of precipitated carbide or the $B_{10}$ value of the resulting grain-oriented steel sheet in the case where a steel sheet heated in the intermediate annealing is cooled by oil quenching within the temperature range of not higher than 770° C. and the quenched sheet is immediately subjected to an ageing treatment within 2–300 seconds at 200° C. In FIG. 1, the white circle indicates average particle size. For comparison, the same steel sheet heated in the intermediate annealing as described above was forcedly air cooled at a cooling rate corresponding to the commonly used cooling time of 90 seconds within the temperature range of 770°–100° C., and the particle size of the precipitated carbide and the $B_{10}$ value in the resulting steel sheet are also shown in FIG. 1. It can be seen from FIG. 1 that an ageing treatment condition for giving an improved $B_{10}$ value is a condition of 200° C. and 10–20 seconds. Under this condition, the precipitated carbide particles had a size within the range of substantially 100–500 Å, and a large amount of the carbide particles were uniformly dispersed in the crystal grains. While, under an ageing treatment condition, which cannot give an improved $B_{10}$ value, that is, in an oil quenching or in an ageing treatment under a condition of 200° C. and 2 seconds, precipitated carbide particles were not observed in the crystal grains or a very small amount of carbide particles were locally precipitated. Further, it has been found that, when an ageing treatment is carried out at 200° C. for more than 30 seconds, carbide precipitate having a particle size larger than 500 Å is formed and a higher $B_{10}$ value cannot be obtained.

It has been newly found out from the above described experiment that, when a large amount of ultra-fine carbide particles having a size within the range of substantially 100–500 Å are uniformly dispersed in the crystal grains of a steel sheet after the heating in the intermediate annealing and before the final cold rolling, the product has excellent magnetic properties. The formation of such ultra-fine carbide particles is an indispensable condition of the first aspect of the present invention. FIG. 2(A-1) to FIG. 2(B-2) illustrate this reason.

FIG. 2(A-1) is an electron microphotograph in 10,000 magnifications illustrating the precipitated state of carbide particles (average size: 200 Å) in one of the sample steel sheets used in the experiment shown in FIG. 1, after being subjected to an ageing treatment for 10 seconds and before being subjected to the final cold rolling. FIG. 2(A-2) is a pole figure {200} illustrating the primary recrystallization texture in the sample steel sheet shown in FIG. 2(A-1), after the decarburization annealing and before the final annealing. FIG. 2(B-1) is an electron microphotograph in 10,000 magnifications illustrating the precipitated state of carbide particles (average size: 700 Å) before the final cold rolling in a sample steel sheet, which has been forcedly air cooled at a cooling rate corresponding to a cooling time of 90 seconds required in the cooling within the temperature range of 770°–100° C. in the commercially and commonly used continuous annealing shown in FIG. 1. FIG. 2(B-2) is a pole figure {200} illustrating the primary recrystallization texture in the sample steel sheet shown in FIG. 2(B-1), after the decarburization annealing and before the final annealing.

It can be seen from FIGS. 2(A-1) to 2(B-2) that, when a large amount of ultra-fine carbide particles having a size within the range of substantially 100–500 Å are precipitated and dispersed in a steel sheet before the final cold rolling according to the method of the present invention, and the steel sheet is subjected to a final cold rolling and to a decarburization annealing, the decarburized sheet is stronger in the (110)[001] orientation of primary recrystallization texture than a decarburized sheet obtained through a conventional standard cooling. In a steel sheet having a primary recrystallization texture having such strong (110)[001] orientation, only secondary recrystallized grains highly aligned to (110)[001] orientation can be developed selectively at the proceeding of secondary recrystallization during the final annealing following to the decarburization annealing, and hence a grain-oriented silicon steel sheet having excellent magnetic properties, which is formed of secondary recrystallized grains aligned closely to (110)[001] orientation, can be obtained.

In a conventional method for utilizing effectively carbon contained in a steel, a steel sheet heated in the intermediate annealing is merely rapidly cooled in its cooling step, or is rapidly cooled within the temperature range of not lower than 300° C. in its cooling steps, and therefore the effect of ultra-fine carbide particles, which varies at about 200° C. within a short period of time and is newly found out by the inventors, has probably been overlooked.

The reason why the recrystallization texture of steel sheet annealed after cold rolling-recrystallization can be improved by ultra-fine carbide particles, is not clear, but is probably as follows. It is commonly known that the amount of strain accumulated in the interior of crystal grain by the cold rolling varies depending upon the original orientation of crystal grains prior to being cold rolled, and crystal grains having (110)[001] orientation are larger in the accumulation of internal strain than crystal grains having any other orientations. Therefore, the inventors have deduced that ultra-fine carbide particles act to enlarge the difference between the accumulated amounts of internal strain by the cold rolling due to the difference of original orientations of crystal grains, and accordingly crystal grains having (110)[001] orientation are preferentially recrystallized in the early stage of the decarburization annealing following to the cold rolling, whereby the accumulation of recrystallized grains having (110)[001] orientation is probably increased.

The method for precipitating fully ultra-fine carbide particles having a size within the range of substantially 100–500 Å in the crystal grains according to the present invention, and the reason for limiting the condition for precipitating the above described ultra-fine carbide particles will be explained referring to experimental data.

Figure 3:
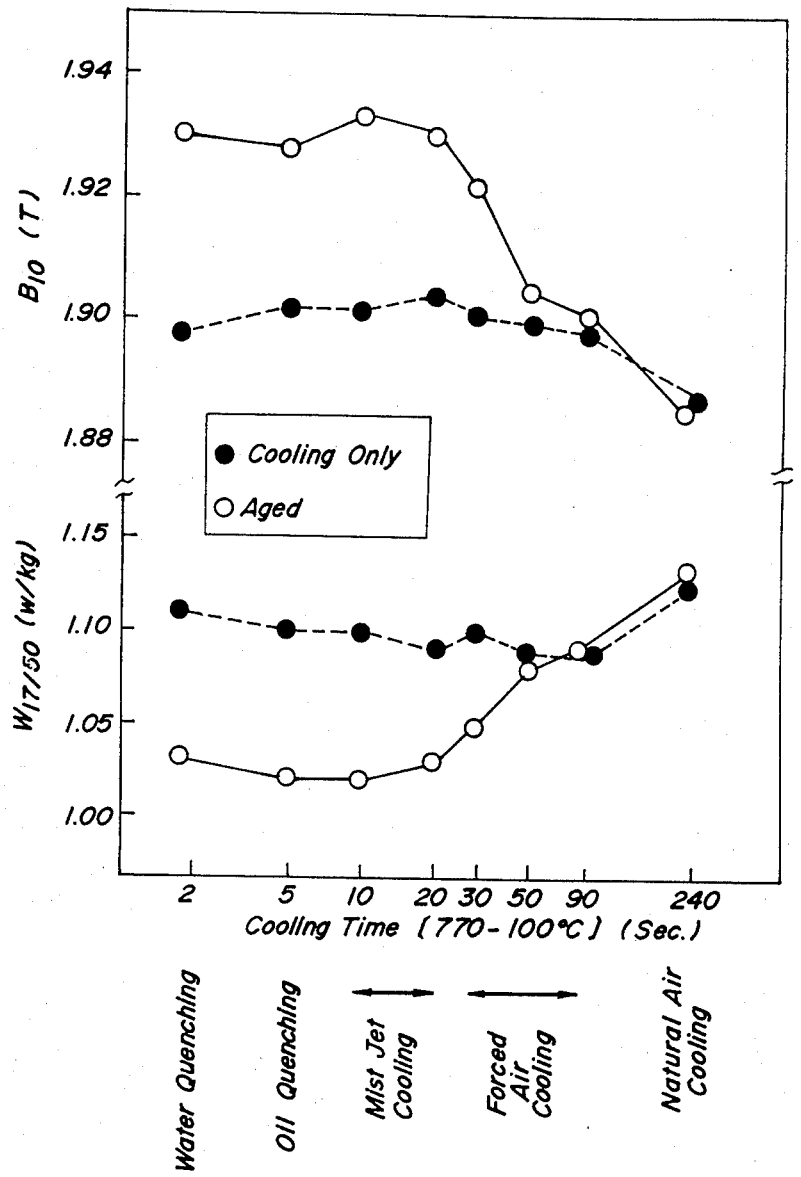
FIG. 3 is a graph illustrating a relation between the cooling time required in the cooling from 770° to 100° C. of a steel sheet heated in an intermediate annealing and the magnetic properties of the product steel sheet.

FIG. 3 illustrates a relation between the cooling time required in the cooling from 770° to 100° C. of a steel sheet heated in an intermediate annealing and the magnetic properties of the product steel sheet in the case where the cooling rate of the steel sheet within the temperature range of 770°–100° C. is variously changed, and in the case where the steel sheet, just after the cooling, is subjected to an ageing treatment at 200° C. for 10 seconds. It can be seen from FIG. 3 that, when the cooling time required in the cooling from 770° to 100° C. is within 30 seconds, the magnetic properties of the product steel sheet is remarkably improved by the ageing treatment. However, when a steel sheet heated in an intermediate annealing is rapidly cooled within 30 seconds and is not subjected to the ageing treatment, the product steel sheet is not satisfactory in the magnetic properties. Observation by an electron microscope showed that such unsatisfactory magnetic properties are based on the fact that ultra-fine carbide particles had not yet been precipitated. While, when the cooling time exceeds 30 seconds, the magnetic properties of the product steel sheet is insufficient independently of the presence of the ageing treatment. However, observation by an electron microscope showed that carbide particles precipitated in the crystal grains had a size of larger than 500 Å, and a large number of carbide particles precipitated on the grain boundary were dispersed, and hence a proper particle size and sufficiently large amount of carbide particles precipitated in the crystal grains are not secured. Accordingly, it is clear that a necessary condition for obtaining an aimed ultra-fine carbide particles is that a steel sheet heated in an intermediate annealing is rapidly cooled within 30 seconds within the temperature range of 770°–100° C. and the rapidly cooled steel sheet is subjected to an ageing treatment.

The condition for the ageing treatment carried out after the rapid cooling will be explained.

Figure 4:
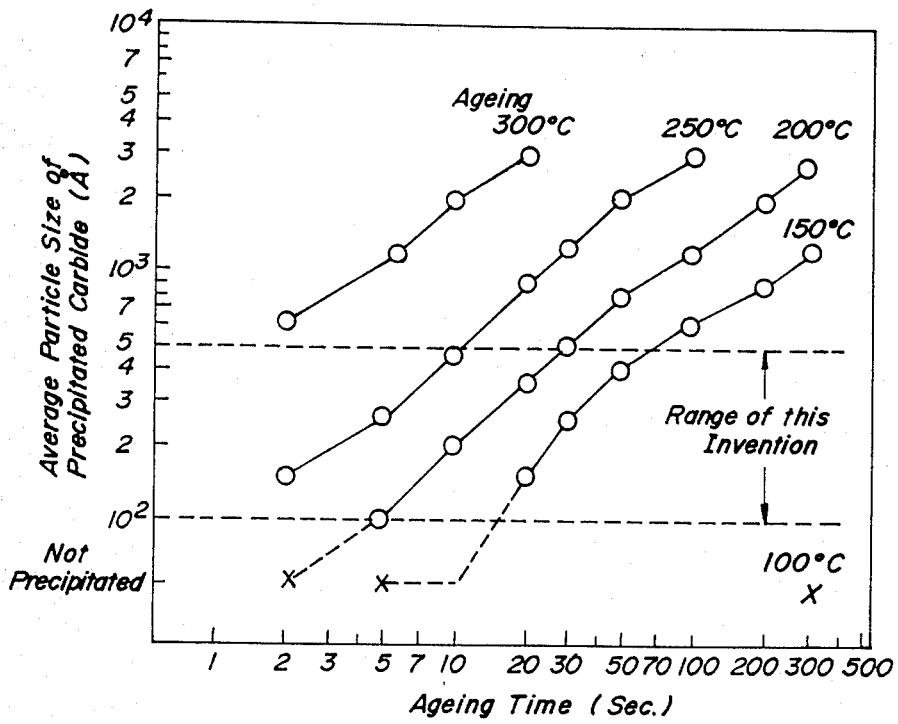
FIG. 4 is a graph illustrating a relation between the ageing condition and the particle size of precipitated carbide in the case where a steel sheet heated in an intermediate annealing is rapidly cooled and then subjected to an ageing treatment.

FIG. 4 illustrates variation of average particle size of carbide precipitated in the crystal grains due to the ageing temperature and ageing time in the case where a steel sheet heated in an intermediate annealing is rapidly cooled within 20 seconds within the temperature range of 770°–100° C. and the rapidly cooled steel sheet is immediately subjected to an ageing treatment within the temperature range of 150°–300° C. It can be seen from FIG. 4 that a condition for precipitating ultra-fine carbide particles having a size of substantially 100–500 Å by such ageing treatment is that the rapidly cooled steel sheet is kept within the temperature of 150°–250° C. for 2–60 seconds. In this case, when the temperature is lower, the steel sheet should be kept for a longer time.

It is easy to apply the above described method, wherein a steel sheet heated in an intermediate annealing is rapidly cooled and the rapidly cooled steel sheet is immediately subjected to an ageing treatment, to an intermediate annealing carried out in a conventional continuous annealing furnace by merely remodeling the furnace in the following manner. That is, the cooling zone of a conventional continuous annealing furnace is converted into an installation capable of carrying out a rapid cooling under the above described condition, and further a low-temperature heating furnace having a short length is additionally arranged.

The inventors have further investigated how to obtain the ultra-fine carbide particles aimed in the present invention by controlling the cooling step in the intermediate annealing, particularly the cooling step within the temperature range of not higher than 300° C., which has hitherto been overlooked, and attempted to omit the above described ageing treatment.

The inventors took notice of the fact that the ultra-fine carbide particles are precipitated within the temperature range of 300°–150° C. as illustrated in FIG. 4, and made an experiment, wherein a steel sheet heated in an intermediate annealing is rapidly cooled within the temperature range of 770°–300° C. and the rapidly cooled steel sheet is cooled at a variant cooling rate within the temperature range of 300°–150° C. It can be seen that, when the cooling time of 30 seconds required in the rapid cooling within the temperature range of 770°–100° C. obtained in FIG. 3 is interpolated, the rapid cooling within the temperature range of 770°–300° C. of a steel sheet heated in an intermediate annealing must be carried out within 20 seconds.

Figure 5:
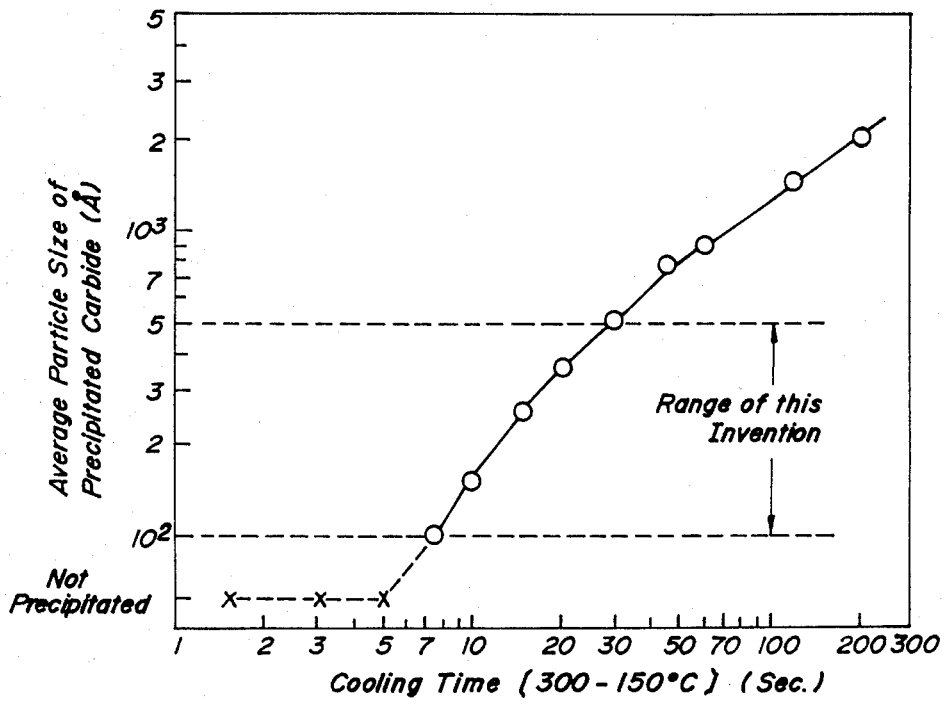
FIG. 5 is a graph illustrating a relation between the cooling time required in the cooling within the temperature range of 300°–150° C. of a steel sheet heated in an intermediate annealing and the particle size of precipitated carbide in the case where the steel sheet is rapidly cooled within the temperature range of 770°–300° C. and the rapidly cooled steel sheet is cooled from 300° to 150° C. in a variant cooling time.

FIG. 5 illustrates a relation between the cooling time required in the cooling within the temperature range of 300°–150° C. and the average particle size of carbide precipitated in the crystal grains in the case where a steel sheet heated in an intermediate annealing is rapidly cooled within the temperature range of 770°–300° C. in 15 seconds by mist jet cooling, and the rapidly cooled sheet is cooled within the temperature range of not higher than 300° C. by a variant cooling rate by changing the cooling method from water quenching to natural air cooling. It can be seen from FIG. 5 that the cooling time required in the cooling from 300° to 150° C. must be selected within the range of 8–30 seconds in order to obtain aimed particle size of precipitated carbide.

The reason why the lower limit of the ageing temperature shown in FIG. 4 or the lower limit of the finishing temperature of cooling shown in FIG. 5 is limited to 150° C. is as follows. The precipitation speed of carbide particles is noticeably decreased within the temperature range of lower than 150° C., and a very long period of time is required in order to obtain an aimed particle size of precipitated carbide; or carbide has already fully precipitated during the course of cooling within the temperature range of not lower than 150° C.

As described above, as seen from FIGS. 3–5, there are two methods for cooling a steel sheet heated in an intermediate annealing so as to obtain in a commercial scale ultra-fine carbide particles having a size of substantially 100–500 Å; the one is a method, wherein a steel sheet heated in an intermediate annealing is rapidly cooled within the temperature range of 770°–100° C. within 30 seconds and the rapidly cooled sheet is immediately subjected to an ageing treatment at a temperature of 150°–250° C. for 2–60 seconds; and the other is a method, wherein a steel sheet heated in an intermediate annealing is rapidly cooled within the temperature range of 770°–300° C. within 20 seconds and the rapidly cooled sheet is cooled from 300° to 150° C. within 8–30 seconds. The inventors have newly found out the above described two cooling methods. These cooling methods can be easily carried out in a commercial scale, and moreover the latter method can shorten the cooling time and operate the continuous heating furnace in a high efficiency, and is an advantageous method.

The steel sheet, which has been treated according to the above described treating pattern in an intermediate annealing, is subjected to a final cold rolling at a final cold rolling reduction rate of 40–80% to produce a finally cold rolled sheet having a final gauge of 0.15–0.50 mm. The reason why the final cold rolling reduction rate is limited to 40–80% is as follows. When the rate is less than 40%, secondary recrystallized grains having a strong (110)[001] orientation cannot be obtained. While, when the rate is more than 80%, a recrystallization texture having a very strong {111} or <110> orientation is formed, and the amount of secondary recrystallized grains having a (110)[001] orientation is very small. Therefore, in both cases, the effect for improving the formation of secondary recrystallized grains having (110)[001] orientation by the precipitation and dispersion of ultra-fine carbide particles according to the present invention is very low or does not appear at all. Accordingly, the reduction rate of the final cold rolling carried out after the precipitation and dispersion of the aimed ultra-fine carbide particles in the crystal grains must be limited to 40–80%.

The finally cold rolled steel sheet is subjected to a decarburization annealing at 750°–850° C. under a wet hydrogen atmosphere to decrease the C content in the steel sheet to not higher than 0.003%, applied with an annealing separator of MgO, and then subjected to a final annealing to obtain a product. The final annealing is carried out in order to develop fully secondary recrystallized grains having (110)[001] orientation and at the same time to remove impurities, such as S, Se, N and the like, contained in the steel, and to form an electrically insulating film consisting mainly of forsterite. The final annealing is generally carried out by keeping the decarburized steel sheet for more than several hours at a temperature of not lower than 1,000° C., preferably at a temperature within the range of 1,050°–1,250° C., under a hydrogen atmosphere. However, in order to exhibit fully the effect of the present invention, it is preferable to carry out the final annealing according to the method disclosed in U.S. Pat. No. 3,932,234, wherein the steel sheet applied with an annealing separator is subjected to a secondary recrystallization annealing by keeping the sheet at a temperature within the range of 820°–900° C. under a hydrogen, nitrogen or argon atmosphere to develop fully the secondary recrystallized grains, and successively subjected to a purification annealing at a temperature of not lower than 1,100° C. under a hydrogen atmosphere to remove the impurities.

The second aspect of the present invention will be explained hereinafter in more detail.

The inventors investigated already the action of γ-phase iron formed during the hot rolling, and found out the following facts. The γ-phase iron formed in a slab used as a starting material during its hot rolling is effective for dividing and breaking crystal grains coarsely grown during the slab heating at higher temperature, but acts harmfully on the precipitation of fine particles of MnS, MnSe and the like, which act as an inhibitor, and particularly the formation of an excessively large amount of γ-phase iron deteriorates greatly the effect of the inhibitor to disturb sufficient development of secondary recrystallized grains. Therefore, it is necessary that the amount of γ-phase iron to be formed during the hot rolling of the slab is kept to a proper range.

Further even when a proper amount of γ-phase iron is formed, the γ-phase iron acts harmfully on the formation of proper crystal structure and recrystallization texture during the cold rolling step after the γ-phase iron has been utilized for dividing coarse crystal grains into small grain size during the hot rolling. The inventors studied variously in order to eliminate the harmful action of γ-phase iron without losing the effective action thereof, and disclosed in U.S. patent application Ser. No. 421,809 now U.S. Pat. No. 4,439,252 a method, wherein the C content in a starting slab is controlled depending upon the Si content in order to form a proper amount of γ-phase iron during the hot rolling, and further a proper amount of C is removed from the steel during the course after completion of hot rolling and just before the beginning of final cold rolling. The inventors have newly found out that, when the above described method of U.S. Pat. No. 4,439,252 is combined with the method of the above described first aspect of the present invention, wherein carbide particles contained in crystal grains of a steel sheet after heating in an intermediate annealing and before final cold rolling are controlled to a specifically limited ultra-fine size, which cannot be observed by an optical microscope and has not hitherto been taken into consideration, and are fully dispersed in the crystal grains, the recrystallization texture of a finally cold rolled and decarburized steel sheet before the final annealing can be formed into a recrystallization texture having strong (110)[001] orientation, and secondary recrystallized grains highly aligned to (110)[001] orientation can be fully developed during the secondary recrystallization stage in the final annealing, resulting in a grain-oriented silicon steel sheet having more improved magnetic properties. This is the second aspect of the present invention.

The requirements in the second aspect of the present invention will be explained referring to experimental data.

Figure 6:
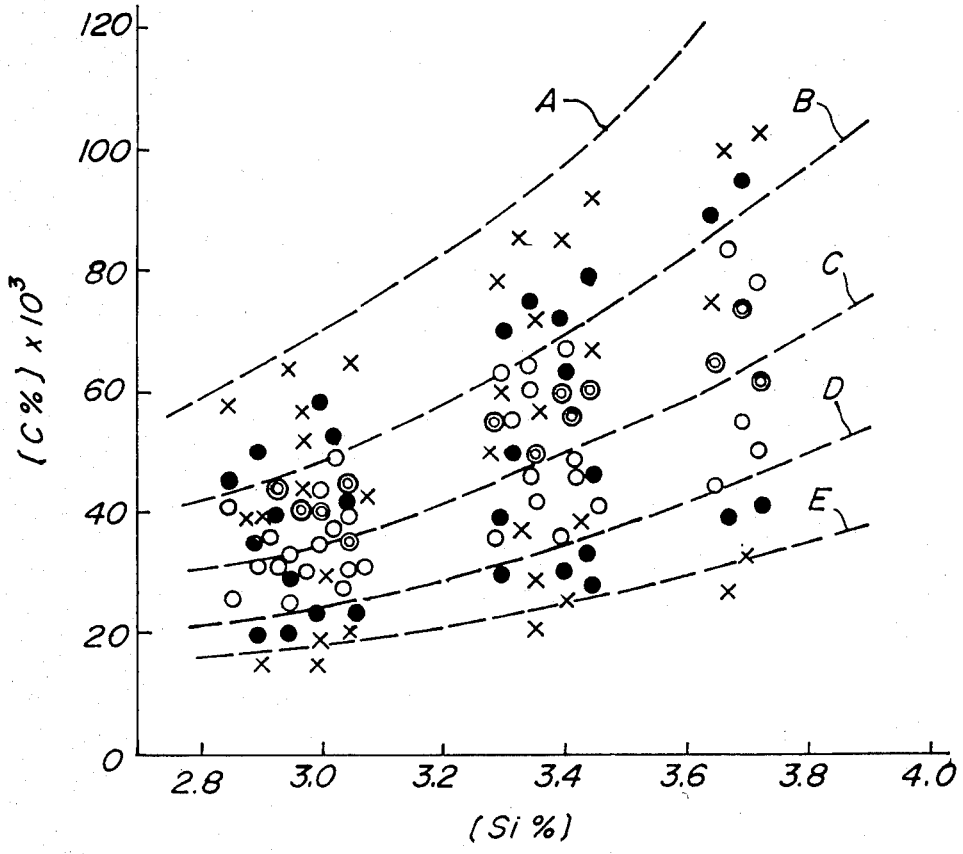
FIG. 6 is a graph illustrating the influences of the Si content and C content in a slab used as a starting material upon the iron loss value of a grain-oriented silicon steel sheet product.

FIG. 6 illustrates relations between the Si or C content in each of continuously cast silicon steel slabs used as a starting material and the iron loss $W_{17/50}$ of each of the resulting grain-oriented silicon steel sheet products in the following experiment. A large number of continuously cast silicon steel slabs, which contained 0.015–0.035% of Se and 0.03–0.09% of Mn as an inhibitor, and contained Si in an amount within each of three groups of 2.8–3.1%, 3.3–3.5% and 3.6–3.8%, and C in a variant amount within the range of 0.01–0.10%, were heated at 1,400° C. for 1 hour and then hot rolled to produce hot rolled sheets having a thickness of 2.5 mm, the hot rolled sheets were subjected to conventional two cold rollings with an intermediate annealing between them to produce finally cold rolled sheets having a final gauge of 0.30 mm, and the finally cold rolled sheets were subjected to a decarburization annealing and a final annealing to obtain the final products of grain-oriented silicon steel sheet. In the above described experiment, the atmosphere of the intermediate annealing was variously changed from decarburizing atmosphere to non-decarburizing atmosphere, and the final cold rolling reduction rate was set within the range of 50–70%.

The marks, ◎, ○, • and x in FIG. 6 indicate the estimation of the iron loss value $W_{17/50}$ of the product steel sheets, according to the standard values shown in the following Table 1, corresponding to the Si content in the sample steel.

TABLE 1

| Iron loss (W/kg) | Marks in FIG. 6 | Range of [Si %] in sample steel 2.8–3.1% | 3.3–3.5% | 3.6–3.8% |
|---|---|---|---|---|
| $W_{17/50}$ | ◎ | ≦1.05 | ≦1.00 | ≦0.95 |
| | ○ | ≦1.10 | ≦1.05 | ≦1.00 |
| | • | ≦1.15 | ≦1.10 | ≦1.05 |
| | x | >1.15 | >1.10 | >1.05 |

The broken lines A, B, C, D and E described in FIG. 6 represent estimated values, calculated from the following formula (1), of the amount of γ-phase iron to be formed at 1,150° C. in the slab during the hot rolling, and represent 40, 30, 20, 10 and 0%, respectively, of the estimated amount of the γ-phase iron to be formed. In general, the amount of γ-phase iron to be formed varies depending upon the Si and C contents in a slab and the heating temperature thereof. The following formula (1) was deduced from the measured values of the Si and C contents in a steel and the measured value of the amount of γ-phase iron formed in the steel under an equivalent condition at 1,150° C. with respect to sample silicon steels containing various amounts of Si and C.

$$\gamma(\%)=67\log([C\%]\times 10^3)-25[Si\%]-8 \quad (1)$$

It can be seen from FIG. 6 and Table 1 that, although there is a difference in the estimation standard of iron loss value between the three groups of sample steels, sample steels capable of giving low iron loss of $W_{17/50}$ to the resulting grain-oriented silicon steel sheets are present between broken lines B and D shown in FIG. 6, that is, the amount of γ-phase iron formed during the hot rolling of sample steels are present within the range of 10–30% independently of the Si content. However, the γ-phase iron formed during the hot rolling is not present under an equilibrium condition, but is present under a metastable condition, and it is difficult to determine accurately the amount of γ-phase iron formed at 1,150° C. during the actual hot rolling. Accordingly, the limitation of the proper range of C content is a steel, which gives low iron loss to the product steel sheet, by the formed amount of γ-phase iron is not proper for practical operation, and it is proper for practical operation that the proper range of C content in a steel, which range satisfy the range of 10–30% of the formed amount of γ-phase iron given by the above described formula (1), is limited depending upon the Si content. Based on this idea, the proper range of C content in a silicon steel used as a starting material for giving a low iron loss to the resulting grain-oriented silicon steel sheet, which C content varies depending upon the Si content in the steel, is given by the following formula (2)

$$0.37[Si\%]+0.27\leqq\log([C\%]\times 10^3)\leqq 0.37[Si\%]+0.57 \quad (2)$$

That is a second requirement to be satisfied in the second aspect of the present invention.

When the C content in a starting steel is lower than the lower limit of the proper range of C content defined by the formula (2) depending upon the Si content, that is, when a starting steel has a composition which forms less than 10% of γ-phase iron during the hot rolling, the product steel sheet has a distinct fine grain streak and is poor in the magnetic properties. While, when a starting steel has a composition which forms 10% shown by the line D in FIG. 6 or more of γ-phase iron, the product steel sheet has substantially no fine grain streak and consists mainly of normally developed secondary recrystallized grains. Accordingly, in order that coarse crystal grains developed extraordinarily during the slab heating at high temperature are divided into small grain size and broken during the hot rolling and that the formation of fine grain streaks is prevented, it is necessary to form not less than a given amount of γ-phase iron. It has been found out that this given amount of γ-phase iron can be formed by containing C to the slab in such an amount that can form not less than 10% of γ-phase iron, depending upon the Si content, during the hot rolling of the slab when the slab is kept under an equilibrium condition.

While, when a slab contains an excessively large amoun of C, that is, when a slab has a composition which forms more than 30% of γ-phase iron during the hot rolling, the product has a crystal texture which is wholly occupied by fine grains consisting of incompletely developed secondary recrystallized grains, and has very poor magnetic properties.

As described above, the inventors have found out the following fact. Only when the silicon steel to be used in the present invention contains C in such an amount that can form 10–30% of γ-phase iron under an equilibrium condition during the hot rolling depending upon the Si content, the formation of fine grain streaks and the formation of crystal texture occupied wholly by fine grains consisting of incompletely developed secondary recrystallized grains in the product can be prevented, and it is very effective in order to obtain a product having excellent magnetic properties that the silicon steel has a C content defined by the above described formula (2) depending upon the Si content.

However, even when the formed amount of γ-phase iron shown in FIG. 6 is within the range of 10–30%, some of the resulting grain-oriented silicon steel sheets have not a satisfactorily low iron loss, and the limitation of only Si and C contents defined by the formula (2) is still in sufficient in order to produce grain-oriented silicon steel sheets having stable magnetic properties in a commercial scale. The inventors have made various investigations in order to obviate this drawback, and found out that it is very effective to remove 0.006–0.020% of C from the steel during the course after completion of the hot rolling and before the final cold rolling in order to obtain stably a product having excellent magnetic properties. This is a third requirement to be satisfied in the second aspect of the present invention.

Figure 7A:
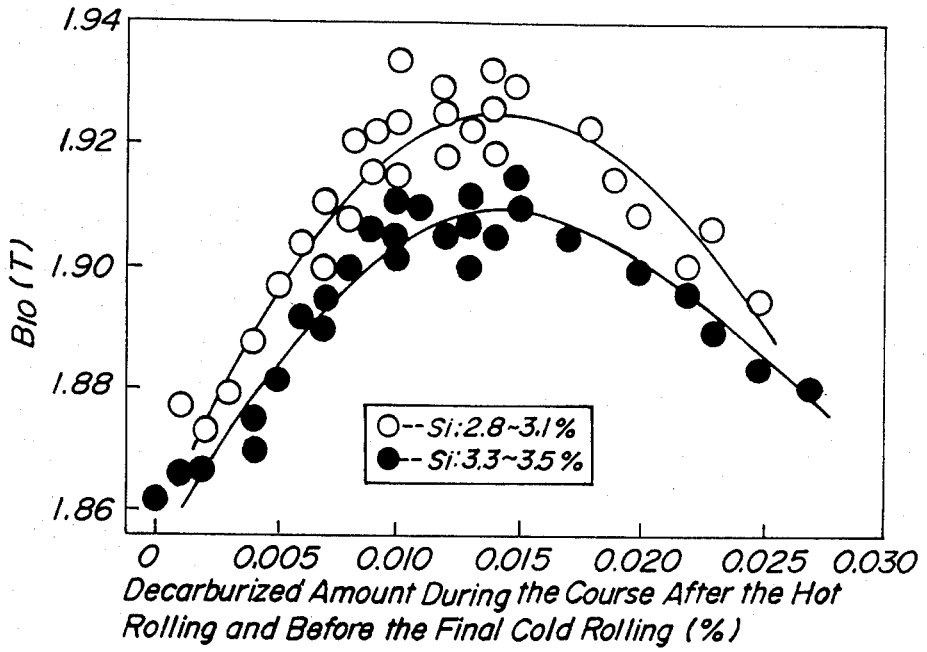
FIG. 7A is a graph illustrating the influence of the decarburized amount $\Delta C$ during the course after the hot rolling and before the final cold rolling upon the magnetic induction $B_{10}$.
Figure 7B:
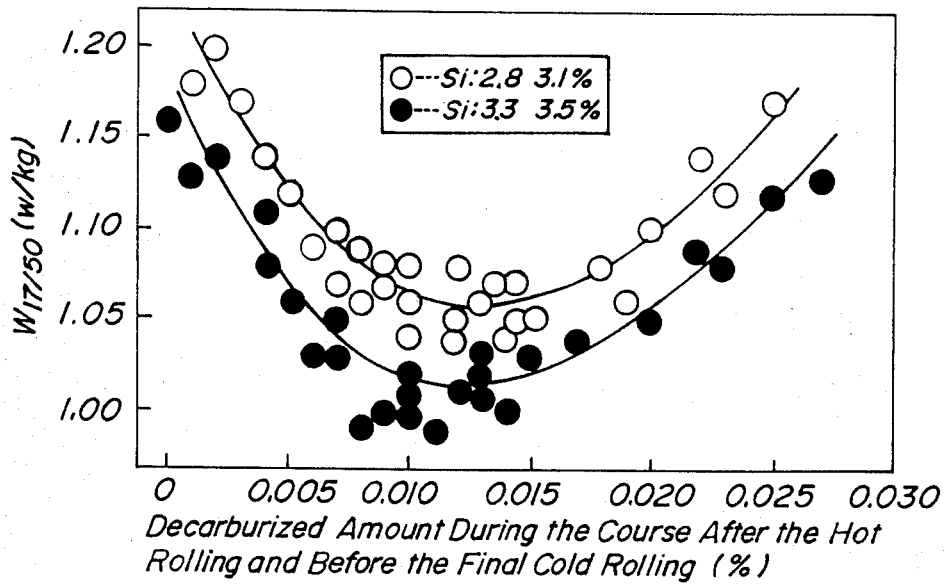
FIG. 7B is a graph illustrating the influence of the decarburized amount $\Delta C$ during the course after the hot rolling and before the final cold rolling upon the iron loss value $W_{17/50}$.

This third requirement has been ascertained by the inventors from the following experiment. That is, grain-oriented silicon steel sheets were produced from slabs having a composition which had an Si content within each of the two groups of 2.8–3.1% and 3.3–3.5% shown in FIG. 6 and had such a C content (which depends upon the Si content) that corresponded to 10–30% of the amount of γ-phase iron to be formed at 1,150° C. during the hot rolling of the slab, and the relation between the magnetic properties of the products and the difference in the C content between the hot rolled sheet and the intermediately annealed sheet before final cold rolling, that is, the relation between the magnetic properties and the decarburized amount (ΔC), was investigated. FIGS. 7A and 7B show the result. FIGS. 7A and 7B are graphs illustrating the relations between the decarburized amount during the course, which is carried out after the hot rolling and before the final cold rolling, and the magnetic induction $B_{10}$(%) and the iron loss $W_{17/50}$, respectively, in a large number of sample steels having an Si content of the group of 2.8–3.1% shown by white circles or having an Si content of the group of 3.3–3.5% shown by black circles in FIGS. 7A and 7B. It can be seen from FIGS. 7A and 7B that, when the decarburized amount ΔC is not less than 0.006% and not more than 0.020%, excellent magnetic properties aimed in the present invention can be stably obtained. While, when ΔC is less than 0.006% or more than 0.020%, the magnetic induction is low and the iron loss is relatively large, and these values are insufficient as the magnetic properties aimed in the present invention.

The decarburized amount during the course after the hot rolling and before the final cold rolling in an ordinary operation is generally 0.005% or less. Therefore, the decarburized amount of 0.006–0.020%, which has been found out to be an effective amount in the present invention, means that the treatments carried out during the course after the hot rolling and before the final cold rolling must be carried out under a particularly limited condition, such as a decarburizing atmosphere. The magnetic properties, which have not been satisfactorily improved by the above described second requirement of the present invention, can be satisfactorily improved by this third requirement of the second aspect of the present invention, wherein a decarburization is forcedly carried out during the course after the hot rolling and before the final cold rolling, and excellent magnetic properties can be stably obtained.

The fact that the above described proper decarburized amount is effective for improving and stabilizing magnetic properties will be clearly understood from the results of observation of crystal texture and recrystallization texture as well. That is, when the decarburized amount is proper, the crystal grain size before the final cold rolling is uniform and proper, and the primary recrystallization texture is a preferable texture having a strong (110)[001] orientation, and the product steel sheet consists of fully developed normal secondary recrystallized grains. While, when the decarburized amount is short, the primary recrystallization structure is not uniform in the crystal grain size, contains massive carbide particles, and the primary recrystallization texture is an unfavorable one composed of weak (110)[001] orientation and relatively strong (111)<11$\bar{2}$> orientation, and as a result the crystal structure of product steel sheet is a mixed texture formed of fine grains and incompletely developed secondary recrystallized grains. When the decarburized amount is excess, the crystal grain size before the final cold rolling is not uniform and coarse crystal grains are dispersed, and the primary recrystallization texture is unfavorable due to a small amount of recrystallized grains having (110)[001] orientation, and therefore the crystal structure of the product steel sheet resulted from such recrystallization texture is occupied by extraordinarily coarse secondary recrystallized grains, and many of these grains have orientations deviated from (110)[001] orientation, and the product steel sheet is insufficient in the magnetic properties.

As described above, the inventors have already found out that a proper amount of decarburization is effective for the improvement and stabilization of magnetic properties, and disclosed U.S. patent application Ser. No. 421,809 as described above. The inventors have combined the method of the U.S. patent application with the first aspect of the present invention, and succeeded in the production of grain-oriented silicon steel sheets having remarkably excellent magnetic properties in a high magnetic induction and in a low iron loss value $W_{17/50}$ of not higher than 1.10 W/kg.

The first requirement of the second aspect of the present invention will be explained hereinafter referring to experimental data.

A hot rolled steel sheet having a composition containing 0.045% of C, 3.20% of Si, 0.06% of Mn, 0.025% of Se and 0.020% of Sb, and having a thickness of 3.0 mm, which had been produced through conventional steelmaking, continuous casting and hot rolling steps, was used as a starting steel sheet in this experiment. The hot rolled sheet was annealed at 950° C. for 2 minutes, pickled and then subjected to a first cold rolling to produce a first cold rolled sheet having an intermediate thickness of 0.75 mm. The first cold rolled sheet was intermediately annealed at 900° C. for 3 minutes, and the intermediately annealed sheet was subjected to a final cold rolling under a reduction rate of 60% to produce a finally cold rolled sheet having a final gauge of 0.30 mm. The finally cold rolled sheet was subjected to a decarburization annealing under a wet hydrogen atmosphere kept at 800° C., applied with MgO, and subjected to a final annealing by keeping the steel sheet at 1,200° C. for 10 hours to produce a product of grain-oriented silicon steel sheet.

Figure 8:
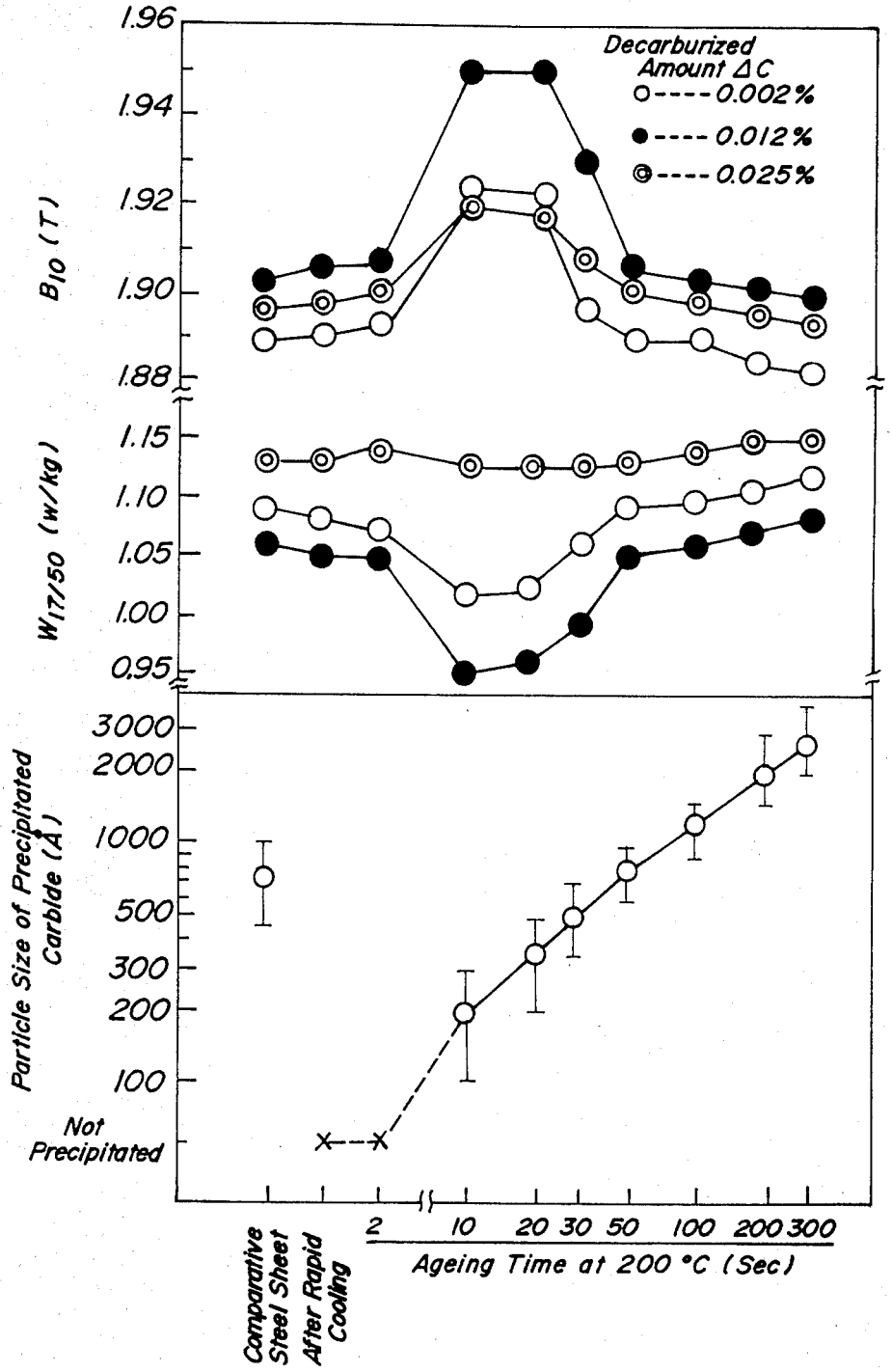
FIG. 8 shows graphs illustrating relations between the ageing time and the particle size of precipitated carbide or the magnetic properties in different levels of decarburized amount in the case where steel sheets heated in an intermediate annealing are rapidly cooled and then subjected to an ageing treatment at 200° C.

In the above described experiment, the amount of C to be removed during the intermediate annealing was varied to three levels of 0.002%, 0.012% and 0.025%: the decarburized amount ΔC of 0.002% is a conventional ordinary amount, that of 0.012% is an amount within the range defined in the present invention, and that of 0.025% is an excess amount. Moreover, the steel sheet heated to 900° C. in the intermediate annealing was cooled such that the cooling of the steel sheet from 770° C. was carried out by oil quenching (rapid cooling corresponding to a cooling time of about 10 seconds in the cooling from 770° to 100° C.), and then the steel sheet was immediately subjected to an ageing treatment at 200° C. for a variant ageing time of 2–200 seconds. FIG. 8 illustrates relations between the ageing time at 200° C. and the particle size of carbide precipitated in the crystal grains of the aged steel sheet before the final cold rolling, or the magnetic properties of the product steel sheet. In FIG. 8, the mark ○ indicates the sample steel sheet whose decarburized amount ΔC is 0.002%; the mark • indicates the sample steel sheet whose decarburized amount ΔC is 0.012%; and the mark ◎ indicates the sample steel sheet whose decarburized amount ΔC is 0.025%. A comparative steel sheet shown in FIG. 8 is one treated in a method, wherein a steel sheet heated in the intermediate annealing is forcedly air cooled within the temperature range of 770°–100° C. at a rate corresponding to 98 seconds commonly used for cooling from 770° to 100° C. in an industrial continuous annealing.

It can be seen from FIG. 8 that, when the ageing time at 200° C. is about 10–20 seconds and moreover the decarburized amount is a proper amount (mark • within the range defined in the third requirement of the present invention, the product steel sheet has very excellent magnetic properties of a high magnetic induction value $B_{10}$ of at least 1.94 and a very low iron loss value $W_{17/50}$ (W/kg) of not higher than 1.00 W/kg, and further the particle size of carbide precipitated in the crystal grains in the aged steel sheet was within the range of substantially 100–500 Å.

Further, it can be seen from FIG. 8 that, when the decarburized amount ΔC is a conventional ordinary amount (mark ○), or is excess (mark ◎), the magnetic properties are somewhat improved, but cannot be remarkably improved even in the case where a steel sheet heated in an intermediate annealing is rapidly cooled and immediately subjected to an ageing treatment at 200° C. for about 10–20 seconds.

It can be seen from the results of the above described experiment that, when a proper amount of C is removed from a steel sheet and the steel sheet is subjected to a treatment capable of precipitating carbide particles having a size within the range of substantially 100–500 Å in the crystal grains of the intermediately annealed steel sheet before final cold rolling, the magnetic properties of the resulting grain-oriented silicon steel sheets can be remarkably improved.

Figure 9:
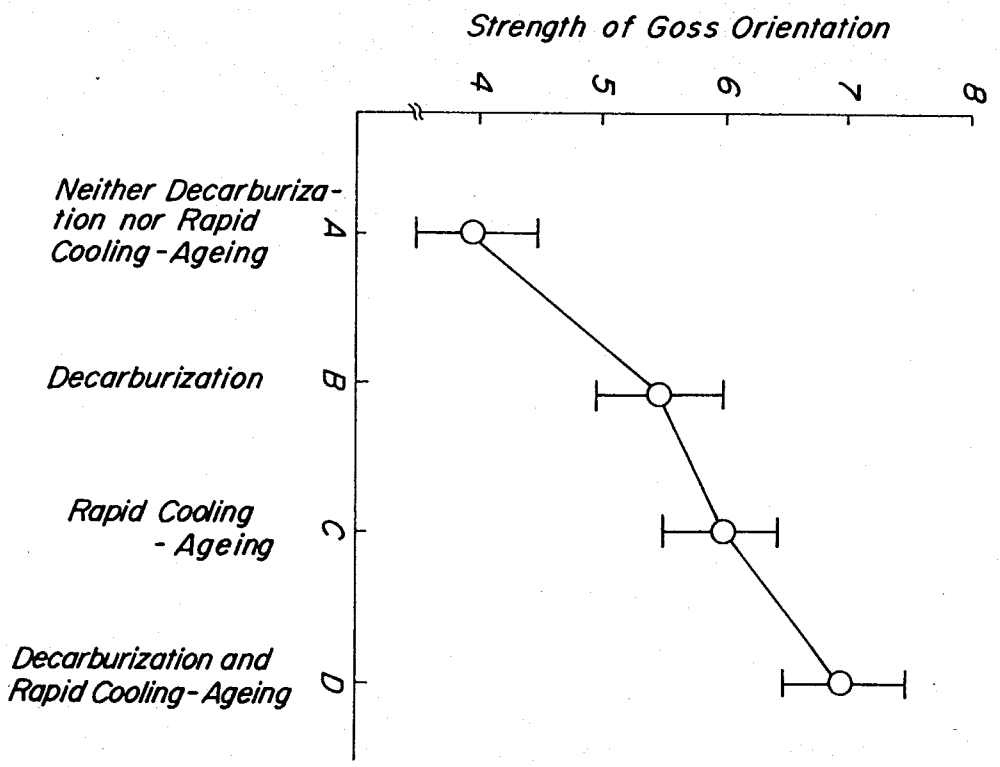
FIG. 9 is a graph illustrating variation of the intensity of Goss orientation at the steel sheet surface after decarburization annealing due to the decarburization treatment carried out during the intermediate annealing step of the steel sheet and to the rapid cooling-ageing treatment carried out after the steel sheet is heated in the intermediate annealing.

Further, the inventors produced four kinds of cold rolled sheets through the following four kinds of treatments (A)–(D); treatment (A): decarburization of a steel sheet was not carried out in an intermediate annealing step carried out before final cold rolling, and further the steel sheet heated in the intermediate annealing step was not rapidly cooled but was cooled at a standard cooling rate corresponding to about 90 seconds required for cooling the steel sheet from 770° to 100° C.; treatment (B): 0.006–0.020% of C was removed from a steel sheet during an intermediate annealing step before final cold rolling, and the steel sheet heated in the intermediate annealing step was not rapidly cooled, but was cooled at the standard cooling rate; treatment (C): decarburization of a steel sheet was not carried out during an intermediate annealing step before final cold rolling, and the steel sheet heated in the intermediate annealing step was rapidly cooled within 30 seconds within the temperature range of 770°–100° C., and the rapidly cold steel sheet was immediately subjected to an ageing treatment at 200° C. for about 10–20 seconds; and treatment (D): 0.006–0.020% of C was removed from a steel sheet during an intermediate annealing step before final cold rolling, and the steel sheet heated in the intermediate annealing step was subjected to the same rapid cooling and ageing treatment as those carried out in the above described treatment (C). FIG. 9 illustrates the intensities of Goss orientation at the surface layer of the above obtained four kinds of steel sheets after decarburization annealing and before final annealing. It can be seen from FIG. 9 that, in the steel sheet after decarburization annealing and before final annealing, the steel sheets obtained through treatments (B) wherein only decarburization is carried out, or through treatment (C) wherein only rapid cooling-ageing treatment is carried out, have an intensity of Goss orientation of about 1.5 times that of the steel sheet obtained through treatment (A) wherein neither decarburization nor rapid cooling-ageing treatment are carried out, and further that the steel sheet obtained through treatment (D) wherein both decarburization and rapid cooling-ageing treatment are carried out, has an intensity of Goss orientation as high as about 1.7 times that of the steel sheet obtained through treatment (A). The reason why the intensity of Goss orientation is increased according to the present invention is probably as follows. That is, the removal of a proper amount of C lowers the recrystallization-beginning temperature at the intermediate annealing carried out before final cold rolling, develops advantageously Goss oriented grains which are thought to be recrystallized at a lower temperature, and decreases the amount of $\alpha$-$\gamma$ transformation during the soaking period after recrystallization, whereby the recrystallization texture is prevented from being randomized, and a recrystallization texture having strong Goss orientation is obtained. Moreover, ultra-fine carbide particles, which have been precipitated and dispersed in a steel sheet before final cold rolling, serve to enlarge the difference of the accumulated amounts of internal strain, which is caused depending upon the orientation of initial crystals at the final cold rolling. As a result, crystal grains after cold rolling, which have (110)[001] orientation and an orientation near to (110)[001] orientation, and have a larger amount of strain accumulated therein, begin to recrystallize preferentially at an early stage of recrystallization during the temperature-raising step of decarburization annealing following to the final cold rolling, whereby primary recrystallization texture having a stronger Goss orientation are formed. Accordingly, recrystallization texture having a stronger Goss orientation is obtained by the synergistic effect of the above described two actions.

While, when the decarburized amount before the final cold rolling is short, the primary recrystallization structure before the final cold rolling has not a uniform crystal grain size, and extraordinary fine crystal grains are formed into massive and distributed in the normally recrystallized structure, and further the primary recrystallization texture is an unfavorable one, wherein the intensity of primary recrystallized grains having (110)[001] orientation is low and crystal grains having relatively strong $(111)\langle 11\bar{2}\rangle$ orientation are dispersed. Therefore, even when the steel sheet is rapidly cooled during the cooling step of an intermediate annealing, which is carried out before final cold rolling, to precipitate and disperse very fine carbide particles having a size of substantially 100–500 Å, the effect of the fine carbide particles is very reduced, and the crystal texture of the product steel sheet is a mixed texture formed of fine grains and incompletely developed secondary recrystallized grains.

Further, when the decarburized amount is excess, the crystal grain size before the final cold rolling is not uniform and a large number of coarse crystal grains having unfavourable orientations are dispersed, and the recrystallization texture is unfavorable due to the development of a small amount of recrystallized grains having a (110)[001] orientation. Moreover, due to the excess of decarburized amount, a sufficiently large amount of carbide particles are not precipitated during the cooling in the intermediate annealing carried out before final cold rolling, and a sufficiently large amount of aimed very fine carbide particles cannot be secured by rapid cooling. Accordingly, the crystal structure of the product resulted from such recrystallization texture is occupied by extraordinarily coarse secondary recrystallized grains, and many of these secondary recrystallized grains have orientations somewhat deviated from the (110)[001] orientation, and the product is insufficient in the magnetic properties and is apt to have a high iron loss value.

As described above, only when a proper amount of C is removed from a steel sheet before final cold rolling and at the same time carbide particles having an aimed very fine size are precipitated in the crystal grains of the steel sheet before final cold rolling, a very low iron loss value and a very high magnetic induction can be obtained in the resulting grain-oriented silicon steel sheet.

Figure 10:
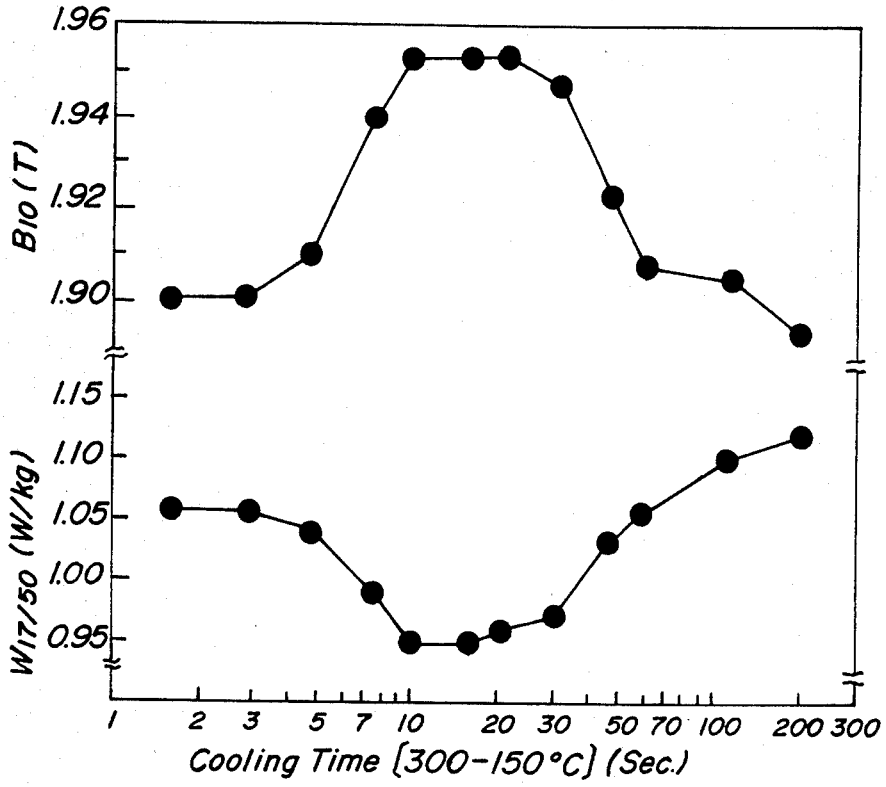
FIG. 10 is a graph illustrating the relation between the cooling time required in the cooling of a steel sheet within the temperature range of 300°–150° C. and the magnetic properties of the steel sheet product in the case where a sample steel sheet heated in an intermediate annealing is rapidly cooled within the temperature range of 770°–300° C. and then cooled from 300° to 150° C. in a variant cooling time.

The inventors have tried to develop a method capable of producing grain-oriented silicon steel sheets having the above described more improved magnetic properties without carrying out the ageing treatment after cooling in the intermediate annealing by controlling strictly the cooling step within the temperature range of not higher than 300° C., which step has hitherto been overlooked among the cooling steps in intermediate annealing. That is, by taking into consideration the fact that ultra-fine carbide particles are precipitated in the crystal grains at a temperature range of 300° C. to about 150° C. as illustrated in FIG. 4, a steel sheet was subjected to a decarburization treatment during an intermediate annealing carried out before final cold rolling so as to remove 0.012% of C from the steel sheet, and further the steel sheet heated in the intermediate annealing was rapidly cooled within the temperature range of 770°–300° C. in 15 seconds by a mist jet cooling and the rapidly cooled steel sheet was cooled from 300° to 150° C. at a variant cooling rate by changing the cooling method from water quenching to natural air cooling. Relations between the time required in the cooling from 300° to 150° C. and the particle size of carbide precipitated in the crystal grains or the magnetic properties of the product steel sheet were examined, and results shown in FIG. 10 were obtained.

In the silicon steel to be used in the second aspect of the present invention, the C content must be adjusted to the range defined by the above described formula (2) depending upon the Si content. That is, it is necessary that the C content is limited to the range which corresponds substantially to 10–30% of the amount of $\gamma$-phase iron to be formed at 1,150° C. during the hot rolling as illustrated in FIG. 6. Concrete values of the Si content and C content calculated from the formula (2) are shown in the following Table 2.

TABLE 2

| Si % | C % |
|---|---|
| 3.0 | 0.024–0.048 |
| 3.5 | 0.038–0.075 |
| 4.0 | 0.058–0.115 |

However, when the C content exceeds 0.1%, a long time is required for the decarburization step, and is an expensive operation. Therefore, it is desirable that a necessary amount of C is selected within the range not larger than 0.1%.

The silicon steel to be used in the second aspect of the present invention contains 2.5–4.0% of Si, 0.02–0.15% of Mn, and 0.008–0.080% in a total amount of at least one of S and Se similarly to the steel used in the first aspect of the present invention. Further, the steel may contain grain boundary segregation type elements of Sb, As, Bi, Pb, Sn, Te, Mo, W and the like.

The production method of grain-oriented silicon steel sheet in the second aspect of the present invention will be explained in order of the treating steps.

The silicon steel slab to be used in the second aspect of the present invention may be a slab produced through a conventional ingot making-slabbing method, or a slab produced through a continuous casting method. In the application of the second aspect of present invention to a continuously cast slab, it is particularly effective for the stabilizing and improving the magnetic properties of the resulting grain-oriented silicon steel sheet. The slab is heated at a high temperature of not lower than 1,250° C., subjected to a hot rolling by a commonly known method to produce a hot rolled steel sheet having a thickness of 1.2–5.0 mm, and then coiled. The hot rolled and coiled sheet is occasionally subjected to a normalizing annealing at 750°–1,100° C. The coiled sheet, directly or after the normalizing annealing, is subjected to two cold rollings with an intermediate annealing at 770°–1,100° C. between them to produce a finally cold rolled sheet having a final gauge of 0.15–0.50 mm. During the above described steps, 0.006–0.020% in total of C is removed from steel during the course after the hot rolling and before the final cold rolling, that is, in at least one of the self-annealing step after hot rolling and coiling, the normalizing annealing step and the intermediate annealing step, by adjusting the treating atmosphere to a decarburizing atmosphere. The strength of the decarburizing ability of the annealing atmosphere at the decarburization should be properly adjusted depending upon the composition of the starting slab, sheet thickness, annealing time and the like. When it is intended to carry out a decarburization by utilizing the self-annealing of hot rolled and coiled sheet, a decarburization annealing of the hot rolled and coiled sheet can be carried out, for example, by applying $Fe_2O_3$ or other oxide to the coiled sheet surface.

Moreover, during the cooling step of the steel sheet heated in the intermediate annealing carried out before the final cold rolling in the above described cold rolling step, ultra-fine carbide particles having a size of substantially 100–500 Å are fully precipitated and dispersed in the crystal grains of the steel sheet before the final cold rolling by carrying out one of the above described cooling methods, and the cooled steel sheet is finally cold rolled into a final gauge at a final cold rolling reduction rate of 40–80%. In the second aspect of the present invention, a proper amount of C is removed from a steel sheet and at the same time very fine carbide particles are precipitated in the crystal grains of the steel sheet before the steel sheet is subjected to a final cold rolling, whereby uniform crystal structure is formed and the development of recrystallization texture having strong (110)[001] orientation is promoted. This effect cannot be attained when the final cold rolling reduction rate is lower than 40% or higher than 80%, but can be attained only when the final cold rolling reduction rate is within the range of 40–80%.

After completion of the above described cold rolling step, the cold rolled steel sheet is subjected to a decarburization annealing and a final annealing in the same manner as described in the first aspect of the present invention.

The following examples are given for the purpose of illustration in this invention and are not intended as limitations thereof.

EXAMPLE 1

Each of hot rolled steel sheets having a composition containing 0.038% of C, 3.05% of Si, 0.07% of Mn and 0.025% of S, and having a thickness of 2.5 mm, which had been produced through conventional steel-making and hot rolling steps, was annealed at 900° C. for 5 minutes, pickled and then subjected to a first cold rolling to produce a first cold rolled sheet having an intermediate sheet thickness of 0.70 mm. The steel sheet was then intermediately annealed at a temperature of 925° C. for 3 minutes, cooled under a condition that the cooling time from 770° to 100° C. was 20 or 40 seconds, and immediately subjected to an ageing treatment at 200° C. for a variant period of time of maximum 100 seconds.

Then, the above treated steel sheet was subjected to a final cold rolling at a reduction rate of 57% to produce a finally cold rolled sheet having a final gauge of 0.30 mm, and the finally cold rolled sheet was subjected to a decarburization annealing at 800° C. for 5 minutes under a wet hydrogen atmosphere, applied with an MgO slurry, and immediately subjected to a final annealing by a box annealing, wherein the steel sheet was heated up to 1,150° C. and kept at this temperature for 15 hours, to obtain a product of grain-oriented silicon steel sheet.

The magnetic properties of the resulting products are shown in the following Table 3.

It can be seen from Table 3 that the product of the present invention is superior in the magnetic properties to conventional product.

TABLE 3

| Cooling time from 770 to 100° C. (sec) | Ageing time at 200° C. (sec) | Particle size of precipitated carbide (Å) | $W_{17/50}$ (W/kg) | $B_{10}$ (T) | Remarks |
|---|---|---|---|---|---|
| 20 | not aged | not precipitated | 1.22 | 1.84 | Comparative |
| | 3 | a very slight amount is precipitated | 1.23 | 1.84 | steel |
| | 10 | 200 | 1.13 | 1.89 | Steel of |
| | 20 | 400 | 1.15 | 1.88 | this invention |
| | 40 | 700 | 1.21 | 1.85 | Comparative |
| | 100 | 1,200 | 1.32 | 1.80 | steel |
| 40 | not aged | 600 | 1.25 | 1.83 | |
| | 10 | 600 | 1.24 | 1.83 | |
| | 100 | 1,000 | 1.28 | 1.81 | |

EXAMPLE 2

Each of hot rolled steel sheets having a composition containing 0.054% of C, 3.25% of Si, 0.06% of Mn, 0.023% of Se and 0.02% of Sb was annealed at 950° C. for 2 minutes, pickled and then made into an intermediate sheet thickness of 1.0 mm through a first cold rolling. The first cold rolled steel sheet was subjected to an intermediate annealing at 1,000° C. for 2 minutes, and then cooled under a condition that the above heated steel sheet was cooled within the range of 770°–300° C. in 15 or 60 seconds, and successively cooled from 300° to 150° C. in 15 or 50 seconds. The cooled steel sheet was then subjected to a final cold rolling at a reduction rate of 70% to produce a finally cold rolled sheet having a final gauge of 0.30 mm, and the finally cold rolled sheet was subjected to a decarburization annealing at 830° C. for 3 minutes under a wet hydrogen atmosphere, applied with an MgO slurry, and then subjected to a final annealing, wherein the steel sheet was kept at 830° C. for 50 hours in order to develop completely secondary recrystallization during the course of temperature-raising and successively subjected to a purification annealing at 1,200° C. for 10 hours, to obtain a product of grain-oriented silicon steel sheet.

The magnetic properties of the resulting products are shown in the following Table 4. It can be seen from Table 4 that the product of the present invention is superior in the magnetic properties to conventional product.

TABLE 4

| Cooling time from 770 to 300° C. (sec) | Cooling time from 300 to 150° C. (sec) | Particle size of precipitated carbide (Å) | $W_{17/50}$ (W/kg) | $B_{10}$ (T) | Remarks |
|---|---|---|---|---|---|
| 15 | 15 | 300 | 0.98 | 1.94 | Steel of this invention |
| | 50 | 650 | 1.06 | 1.90 | Comparative |
| 60 | 15 | 800 | 1.07 | 1.90 | steel |
| | 50 | 950 | 1.10 | 1.89 | |

EXAMPLE 3

A continuously cast slab having a composition containing 3.15% of Si, 0.045% of C, 0.07% of Mn and 0.025% of S and having a thickness of 200 mm was heated at 1,380° C. for 1 hour, hot rolled into a thickness of 2.5 mm, and then coiled. The hot rolled and coiled sheet was pickled, and subjected to a first cold rolling to produce a first cold rolled sheet having an intermediate sheet thickness of 0.70 mm. Successively, the first cold rolled sheet was subjected to an intermediate annealing at 925° C. for 3 minutes under a wet hydrogen atmosphere of $P_{H2O}/P_{H2}=0.003$–$0.35$ to remove three levels of C of 0.003%, 0.012%, or 0.025%. The decarburized amount ΔC of 0.003% is smaller than the amount defined in the second aspect of the present invention; the decarburized amount of ΔC of 0.012% is within the range defined in the second aspect of the present invention; and the decarburized amount ΔC of 0.025% is larger than the amount defined in the second aspect of the present invention. The intermediately annealed sheet was cooled according to one of the following conditions (A) and (B); condition (A): the steel sheet was cooled within the temperature range of 770°–300° C. in 15 seconds and further cooled from 300° to 150° C. in 15 seconds; and condition (B): the steel sheet was cooled within the temperature range of 770°–300° C. in 60 seconds and further cooled from 300° to 150° C. in 15 seconds. The cooled steel sheet was subjected to a final cold rolling at a reduction rate of 57% to obtain a finally cold rolled sheet having a final gauge of 0.30 mm. The finally cold rolled sheet was subjected to a decarburization annealing at 800° C. for 5 minutes under a wet hydrogen atmosphere, applied with an MgO slurry, immediately subjected to a final annealing by a box annealing, wherein the steel sheet was heated up to 1,150° C. and kept at this temperature for 15 hours, and then applied with an insulating coating to obtain a product of grain-oriented silicon steel sheet. The magnetic properties (magnetic induction $B_{10}$ and iron loss $W_{17/50}$) of the products are shown in the following Table 5 together with their production condition.

TABLE 5

| Sample steel No. | Slab (wt. %) C | Slab (wt. %) Decarburized amount ΔC | Cooling condition | Particle size of precipitated carbide (Å) | $W_{17/50}$ (W/kg) | $B_{10}$ (T) | Remarks |
|---|---|---|---|---|---|---|---|
| 1 | 0.045 | 0.002 | A | 300 | 1.15 | 1.88 | Steel of this invention |
| 2 | | | B | 800 | 1.25 | 1.85 | Comparative steel |
| 3 | | 0.012 | A | 300 | 1.11 | 1.90 | Steel of this invention |
| 4 | | | B | 800 | 1.20 | 1.86 | Comparative steel |
| 5 | | 0.025 | A | 300 | 1.24 | 1.86 | |
| 6 | | | B | 800 | 1.27 | 1.84 | |

Table 5 shows the following facts. In sample steel Nos. 2 and 6, the starting slab has a proper C content. Therefore, it can be thought that a proper amount of γ-phase iron within the range of 10–30% would have been formed. However, the decarburized amount of ΔC is outside the range of 0.006–0.020% defined in the second aspect of the present invention, and moreover the particle size of precipitated carbide is outside the range of 100–500 Å defined in the present invention. Therefore, satisfactorily low iron loss value and high magnetic induction cannot be obtained. In sample steel No. 4, the decarburized amount is satisfied, but the particle size of precipitated carbide is not satisfied. Therefore, the product steel sheet has slightly improved magnetic properties, but has not satisfactorily improved magnetic properties. In sample steel No. 5, the particle size of precipitated carbide is within the range of 100–500 Å defined in the present invention, but the decarburized amount is in excess of the range defined in the second aspect of the present invention. Therefore, the product steel sheet has slightly improved magnetic induction, but has not satisfactorily low iron loss value. Such excessively decarburized amount in sample No. 5 is never obtained in an ordinary operation of intermediate annealing, and consequently sample steel No. 5 is considered as an exception from the first aspect of the present invention. The same consideration is applied to an explanation of the following examples. In sample steel No. 1, wherein the particle size of precipitated carbide is within the range defined in the present invention, but the decarburized amount is below the limited range defined in the second aspect of the present invention, the present steel sheet has satisfactorily improved magnetic properties. In sample steel No. 3, which satisfies all the requirements defined in the second aspect of the present invention, the product steel sheet has concurrently satisfactorily low iron loss value and high magnetic induction.

EXAMPLE 4

A continuously cast slab containing 3.35% of Si, 0.050% of C, 0.06% of Mn, 0.023% of Se and 0.020% of Sb was hot rolled by a commonly known method to produce a large number of hot rolled sheets having a thickness of 2.5 mm. Each of the hot rolled sheets was annealed at 950° C. for 2 minutes, pickled, and subjected to a first cold rolling to produce a first cold rolled sheet having an intermediate sheet thickness of 0.75 mm. Succcessively, the first cold rolled sheet was intermediately annealed at 950° C. for 2 minutes under a wet hydrogen atmosphere of $P_{H2O}/P_{H2}=0.003$–$0.35$ to remove 0.002%, 0.013% or 0.025% of C. The steel sheet heated in the intermediate annealing was cooled under a condition that the cooling time from 770° to 100° C. was 22 seconds. After cooling, the sheet was immediately subjected to an ageing treatment at 200° C. for (A) 0 second (not aged), (B) 10 seconds or (C) 40 seconds. The aged or non-aged steel sheet was finally cold rolled at a reduction rate or 60% into a final gauge of 0.30 mm, and the finally cold rolled sheet was subjected to a decarburization annealing at 830° C. for 3 minutes under a wet hydrogen atmosphere, applied with an MgO slurry, subjected to a secondary recrystallization annealing at 860° C. for 30 hours and a purification annealing at 1,200° C. for 10 hours as a final annealing, and then applied with an insulating coating to obtain a product of grain-oriented silicon steel sheet. The magnetic properties of the products are shown in the following Table 6 together with the treating condition.

TABLE 6

| Sample steel No. | Decarburized amount ΔC (%) | Ageing condition | Particle size of precipitated carbide (Å) | $W_{17/50}$ (W/kg) | $B_{10}$ (T) | Remarks |
|---|---|---|---|---|---|---|
| 7 | 0.002 | A | not precipitated | 1.07 | 1.89 | Comparative steel |
| 8 | | B | 200 | 1.02 | 1.92 | Steel of this invention |

TABLE 6-continued

| Sample steel No. | Decarburized amount ΔC (%) | Ageing condition | Particle size of precipitated carbide (Å) | $W_{17/50}$ (W/kg) | $B_{10}$ (T) | Remarks |
|---|---|---|---|---|---|---|
| 9 | | C | 700 | 1.08 | 1.89 | Comparative |
| 10 | 0.013 | A | not precipitated | 1.06 | 1.90 | steel |
| 11 | | B | 200 | 0.96 | 1.94 | Steel of this invention |
| 12 | | C | 700 | 1.06 | 1.90 | |
| 13 | 0.025 | A | not precipitated | 1.14 | 1.90 | Comparative |
| 14 | | B | 200 | 1.10 | 1.92 | steel |
| 15 | | C | 700 | 1.12 | 1.91 | |

As seen from Table 6, in sample steel Nos. 7 and 9, the precipitated carbide size is outside the range defined in the present invention, and satisfactory magnetic properties are not obtained. In sample steel Nos. 10 and 12, the decarburized amount ΔC is within the range defined in the second aspect of the present invention, but the particle size of precipitated carbide is outside the range defined in the present invention. Therefore, the product steel sheets have slightly improved but still unsatisfactory magnetic properties. In sample steel Nos. 13, 14 and 15, the decarburized amount ΔC is 0.025% and is excess, and the texture of the product steel sheets contains no fine grains, but secondary recrystallized grains are considerably coarse. Therefore, these steel sheets have a relatively high magnetic induction but have not a satisfactorily low iron loss value. Although the precipitated carbide size in sample steel No. 14 is within the range defined in the present invention, the product steel sheet of sample No. 14 has not a satisfactorily low iron loss value. In sample steel No. 8, carbide particles having a size within the range defined in the present invention are precipitated. Nevertheless, the decarburized amount ΔC is not sufficient, and the product steel sheet has satisfactorily excellent magnetic properties. In sample steel No. 11, all the requirements defined in the second aspect of the present invention are satisfied, and the product steel sheet has concurrently ultra-low iron loss value and ultra-high magnetic induction.

EXAMPLE 5

A continuously cast slab containing 3.35% of Si, 0.050% of C, 0.06% of Mn, 0.023% of Se and 0.02% of Sb was hot rolled by a commonly known method to produce a large number of hot rolled sheets having a thickness of 2.5 mm. Each of the hot rolled sheets was annealed at 950° C. for 2 minutes, pickled, and subjected to a first cold rolling to produce a first cold rolled sheet having an intermediate sheet thickness of 0.75 mm. Successively, the first cold rolled sheet was subjected to an intermediate annealing at 950° C. for 2 minutes under a continuous annealing atmosphere for $P_{H2O}/P_{H2}=0.003$–0.35 to remove 0.002%, 0.013% or 0.025% of C. The decarburized amounts ΔC of 0.002% and 0.025% are outside the range defined in the present invention, and the decarburized amount ΔC of 0.013% is within the range defined in the present invention. The steel sheet was then cooled under a condition that the cooling time from 770° to 300° C. was 17 or 70 seconds, and further the cooling time from 300° to 150° C. was 15 or 50 seconds. Then, the steel sheet was finally cold rolled at a reduction rate of 60% into a final gauge of 0.30 mm, and the finally cold rolled sheet was subjected to a decarburization annealing at 830° C. for 3 minutes under a wet hydrogen atmosphere, applied with an MgO slurry, subjected to a secondary recrystallization annealing at 840° C. for 50 hours and a purification annealing at 1,200° C. for 10 hours as a final annealing, and applied with an insulating coating to obtain a product of grain-oriented silicon steel sheet. The magnetic properties of the products are shown in the following Table 7 together with the treating condition.

TABLE 7

| Sample steel No. | Decarburized amount ΔC (%) | Cooling time (sec) From 770 to 300° C. | Cooling time (sec) From 300 to 150° C. | Particle size of precipitated carbide (Å) | $W_{17/50}$ (W/kg) | $B_{10}$ (T) | Remarks |
|---|---|---|---|---|---|---|---|
| 16 | 0.002 | 17 | 15 | 300 | 1.00 | 1.93 | Steel of this invention |
| 17 | | | 50 | 650 | 1.08 | 1.90 | Comparative steel |
| 18 | 0.013 | | 15 | 300 | 0.96 | 1.95 | Steel of this invention |
| 19 | | | 50 | 650 | 1.07 | 1.90 | |
| 20 | 0.025 | | 15 | 300 | 1.08 | 1.92 | |
| 21 | | | 50 | 650 | 1.13 | 1.89 | |
| 22 | 0.002 | 70 | 15 | 800 | 1.09 | 1.89 | Comparative steel |
| 23 | | | 50 | 950 | 1.12 | 1.88 | |
| 24 | 0.013 | | 15 | 800 | 1.06 | 1.90 | |
| 25 | | | 50 | 950 | 1.08 | 1.89 | |
| 26 | 0.025 | | 15 | 800 | 1.13 | 1.90 | |
| 27 | | | 50 | 950 | 1.15 | 1.89 | |

It can be seen from Table 7 that the products of sample steel Nos. 16 and 18 have excellent magnetic properties, and in particular the product of sample steel No. 18 according to the second aspect of the present invention is remarkably higher in the magnetic induction and is remarkably lower in the iron loss value than the products of steels which do not satisfy one or more of the requirements defined in the second aspect of the present invention.

As described above, according to the second aspect of the present invention, the C content in the starting slab is adjusted to a proper amount depending upon the Si content, a proper amount of C is removed from the steel during the course after completion of the hot rolling and before the final cold rolling, and further the particle size of carbide precipitated in the crystal grains of the steel sheet before the final cold rolling is properly controlled, whereby a grain-oriented silicon steel sheet having very excellent magnetic properties of a remarkably high magnetic induction and a remarkably low iron loss value, which can never been attained by a conventional method, can be stably obtained without carrying out particular gradual cooling at high temperature and ageing treatment for a long period of time. Therefore, the sheet can be inexpensively produced in a high efficiency in a commercial scale.

What is claimed is:

1. In a method of producing grain-oriented silicon steel sheets having excellent magnetic properties, wherein a silicon steel having a composition containing, in % by weight, 0.02–0.10% of C, 2.5–4.0% of Si, 0.02–0.15% of Mn, 0.008–0.080% in a total amount of at least one of S and Se is hot rolled into a hot rolled sheet, the hot rolled sheet is subjected to two cold rollings with an intermediate annealing at a temperature of 770°–1,100° C. between them, wherein the final cold rolling is carried out at a reduction rate of 40–80%, to produce a finally cold rolled sheet having a final gauge, and the finally cold rolled sheet is subjected to a decarburization annealing and then to a final annealing, an improvement comprising cooling rapidly from 770° C. to 100° C. within 30 seconds the steel sheet heated in the intermediate annealing, immediately subjecting the rapidly cooled sheet to an ageing treatment at a temperature of 150°–250° C. for 2–60 seconds to precipitate carbide particles having a very fine size of substantially 100–500 Å in a fully dispersed state in the crystal grains of the steel sheet, and then subjecting the steel sheet to the final cold rolling.

2. In a method of producing grain-oriented silicon steel sheets having excellent magnetic properties, wherein a silicon steel having a composition containing, in % by weight, 0.02–0.10% of C, 2.5–4.0% of Si, 0.02–0.15% of Mn, 0.008–0.080% in a total amount of at least one of S and Se is hot rolled into a hot rolled sheet, the hot rolled sheet is subjected to two cold rollings with an intermediate annealing at a temperature of 770°–1,100° C. between them, wherein the final cold rolling is carried out at a reduction rate of 40–80%, to produce a finally cold rolled sheet having a final gauge, and the finally cold rolled sheet is subjected to a decarburization annealing and then to a final annealing, an improvement comprising cooling rapidly from 770° C. to 300° C. within 20 seconds the steel sheet heated in the intermediate annealing, cooling the rapidly cooled sheet from 300° C. to 150° C. in 8–30 seconds to precipitate carbide particles having a very fine size of substantially 100–500 Å in a fully dispersed state in the crystal grains of the steel sheet, and then subjecting the steel sheet to the final cold rolling.

3. A method according to claim 1, wherein the C content in the starting silicon steel is limited, depending upon the Si content, within the range defined by the following formula $$0.37[Si\%]+0.27 \leqq \log([C\%]\times 10^3) \leqq 0.37[Si\%]+0.57$$

wherein [Si%] and [C%] represents contents (% by weight) of Si and C in the steel respectively, and the C content is reduced by 0.006–0.020% by weight from the original C content in the steel during the course after the completion of the above described hot rolling and just before the beginning of the above described final cold rolling.

4. A method according to claim 2, wherein the C content in the starting silicon steel is limited, depending upon the Si content, within the range defined by the following formula $$0.37[Si\%]+0.27 \leqq \log([C\%]\times 10^3) \leqq 0.37[Si\%]+0.57$$

wherein [Si%] and [C%] represent contents (% by weight) of Si and C in the steel respectively, and the C content is reduced by 0.006–0.20% by weight from the original C content in the steel during the course after the completion of the above described hot rolling and just before the beginning of the above described final cold rolling.

* * * * *